US007111921B2

(12) United States Patent
Yoshida

(10) Patent No.: US 7,111,921 B2
(45) Date of Patent: Sep. 26, 2006

(54) CAP MOVING MECHANISM, A LIQUID EJECTING APPARATUS AND A LIQUID EJECTION CHARACTERISTICS MAINTAINING MECHANISM

(75) Inventor: Atsushi Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 237 days.

(21) Appl. No.: 10/757,553

(22) Filed: Jan. 15, 2004

(65) Prior Publication Data

US 2004/0189740 A1 Sep. 30, 2004

(30) Foreign Application Priority Data

Jan. 16, 2003 (JP) ..... 2003-008668
Jan. 9, 2004 (JP) ..... 2004-004705

(51) Int. Cl.
*B41J 2/165* (2006.01)

(52) U.S. Cl. ..... 347/32; 347/22; 347/29

(58) Field of Classification Search ..... 347/32
See application file for complete search history.

(56) References Cited

U.S. PATENT DOCUMENTS 6,224,187 B1 * 5/2001 Inten et al. ..... 347/32
6,270,183 B1 * 8/2001 Gaarder ..... 347/29

FOREIGN PATENT DOCUMENTS

JP 06-271112 A 9/1994
JP 08-225167 A 9/1996
JP 2002-307700 A 10/2002

* cited by examiner

*Primary Examiner*—Vip Patel
*Assistant Examiner*—Brian J. Goldberg
(74) *Attorney, Agent, or Firm*—Sughrue Mion, PLLC

(57) ABSTRACT

A cap moving mechanism for moving a cap for sealing a liquid ejecting head for ejecting liquid to a target, includes a pushing-up part for moving the cap upwards or downwards by rotating, a cam shaft provided integrally with the pushing-up part as a rotating shaft of the pushing-up part, a cam shaft gear including a drive region, which rotates integrally with the cam shaft taken as a rotating shaft, whereby a driving force of a motor for driving the cam shaft is transmitted, and a non-drive region whereby the driving force of the motor is not transmitted and a driving force transmission gear for transmitting the driving force of the motor to the cam shaft gear in order that the cap can be moved downwards from a state in which the cap has been completely moved upwards, after the motor rotates by a predetermined amount from when the cap has been completely moved upwards, and transmitting the driving force of the motor to the cam shaft gear in order that the cap can be moved upwards from a state in which the cap has been completely moved downwards, after the motor rotates by a predetermined amount from when the cap has been completely moved downwards.

12 Claims, 16 Drawing Sheets

CAP MOVING MECHANISM, A LIQUID EJECTING APPARATUS AND A LIQUID EJECTION CHARACTERISTICS MAINTAINING MECHANISM

The present application claims priority from Japanese Patent Applications Nos. 2003-008668 filed on Jan. 16, 2003 and 2004-004705 filed on Jan. 9, 2004, the contents of which are incorporated herein by reference.

BACKGROUND OF THE INVENTION

1. Field of the Invention

The present invention relates to a cap moving mechanism, a liquid ejecting apparatus and a liquid ejection characteristics maintaining mechanism therefor. More particularly, the present invention relates to a cap moving mechanism, a liquid ejecting apparatus and an ejection characteristics maintaining mechanism to move a cap for sealing a liquid ejecting head for ejecting liquid to a target.

2. Description of the Related Art

As an example of a liquid ejecting apparatus, an inkjet type recording apparatus performs recording on a medium to be recorded by ejecting ink from a discharge opening provided at a recording head. The inkjet type recording apparatus includes a cap for sealing a surface on which the discharge opening is formed in case of the cessation of recording, and prevents the discharge opening from drying. The cap holds the ink compulsorily discharged from the discharge opening during cleaning the discharge opening. As an example of a cap moving or capping mechanism to move such a cap for sealing the recording head, there is a method of moving the cap up and down in a direction perpendicular to the recording head by rotating a shaft including a cam directly under the cap as disclosed, for example, in Japanese Patent Application Publication (Laid Open) No. 2002-307700.

In the conventional capping mechanism as described above, however, it is necessary to generate a time lag so as not to transmit the driving force of a motor to the cap during a predetermined time period in order to use various kinds of operations such as moving the cap, feeding the medium to be recorded or the like. As a means for generating the time lag, there is a method of providing means for engaging a claw on the way for a transmission mechanism (or gear) to transmit the power of the motor. In case of the method of providing a claw, however, since the mechanism moving the cap receives the push-up load of the cap when the cap is separated from the recording head and lowered, the cap could not be moved smoothly. In addition, in the method of moving the cap using a gear and a cam, it was difficult to generate the time lag. Further, there occurs a tooth skipping sound where the gear does not rotate against the driving force after the cap has been completely raised or lowered.

Meanwhile, in order to avoid providing the time lag as mentioned above, there is a method of providing a motor for moving the cap and a motor for feeding the medium to be recorded respectively. In this case, however, there is a problem that the number of the parts is increased.

SUMMARY OF THE INVENTION

Therefore, it is an object of the present invention to provide a cap moving mechanism, a liquid ejecting apparatus and an ejection characteristics maintaining mechanism therefor, which is capable of overcoming the above drawbacks accompanying the conventional art. The above and other objects can be achieved by combinations described in the independent claims. The dependent claims define further advantageous and exemplary combinations of the present invention.

According to the first aspect of the present invention, a cap moving mechanism for moving a cap for sealing a liquid ejecting head for ejecting liquid to a target, includes a pushing-up part for moving the cap upwards or downwards by rotating, a cam shaft provided integrally with the pushing-up part as a rotating shaft of the pushing-up part, a cam shaft gear including a drive region, which rotates integrally with the cam shaft taken as a rotating shaft, whereby a driving force of a motor for driving the cam shaft is transmitted, and a non-drive region whereby the driving force of the motor is not transmitted and a driving force transmission gear for transmitting the driving force of the motor to the cam shaft gear in order that the cap can be moved downwards from a state in which the cap has been completely moved upwards, after the motor rotates by a predetermined amount from when the cap has been completely moved upwards, and transmitting the driving force of the motor to the cam shaft gear in order that the cap can be moved upwards from a state in which the cap has been completely moved downwards, after the motor rotates by a predetermined amount from when the cap has been completely moved downwards. The liquid ejecting apparatus of the present embodiment includes the driving force transmission gear can transmit the driving force of the motor to the cam shaft gear or not in response to the rotation amount of the motor. Accordingly, in case the driving force of one motor is used for a purpose other than moving the cap, it is possible not to transmit the driving force of the motor to the cap.

In addition, the driving force transmission gear may include a toothed gear including a drive region whereby the driving force of the motor is transmitted and a non-drive region whereby the driving force of the motor is not transmitted, a spur gear being in contact with the toothed gear and an energizing part for transmitting a rotating force of the spur gear to the toothed gear, and the spur gear rotates freely against the cam shaft taken as a center axis, the spur gear receiving the driving force of the motor, the spur gear energized by the energizing part towards the toothed gear, the toothed gear thereby being rotated accompanying the spur gear. Accordingly, even if the toothed gear is positioned in the non-drive region where it does not receive the driving force of the motor, the toothed gear can be rotated accompanying the rotation of the spur gear. Further, the toothed gear may be capable of rotating freely against the cam shaft taken as a center axis by a predetermined rotation angle. Accordingly, it is possible not to transmit the driving force of the motor to the cap shaft gear while the motor rotates by a predetermined amount.

Further, the drive region of the toothed gear may be arranged in at least a part of an angle area in which the non-drive region of the cam shaft gear is arranged with regard to the cam shaft. Accordingly, the driving force of the motor can be transmitted to the toothed gear even during the time period when the driving force of the motor is not transmitted to the cam shaft gear. Further, the toothed gear may further include two of the non-drive regions between which the drive region is held. Accordingly, the driving force of the motor is not transmitted to the cam shaft in the states where the cap has been completely upwards and downwards, and the driving force of the motor can be transmitted to the cam shaft when the cap is moved upwards from the state the cap has been completely downwards. Further, the toothed gear may be arranged between the cam shaft gear and the spur gear. Accordingly, the toothed gear can transmit the driving force of the motor to the cam shaft, after the motor rotates by a predetermined amount, while it is rotated accompanying the spur gear.

In addition, the cap moving mechanism may further include at least two of the pushing-up parts between which the cam shaft gear, the toothed gear, the spur gear and the energizing part are arranged. Accordingly, as the two of pushing-up parts away from each other by a predetermined distance moves the cap upwards or downwards, the weight of the cap applied to one of the pushing-up parts can be reduced. In addition, the pushing-up part can move the cap upwards or downwards with reliability. Further, the pushing-up part may be cam-shaped. Accordingly, the pushing-up part is the shape of a cam, and thus it can move the cap upward or downwards by rotating together with the cam shaft.

According to the second aspect of the present invention, a liquid ejecting apparatus for ejecting liquid to a target, includes a liquid ejecting head for ejecting liquid to the target, a cap for sealing the liquid ejecting head, a pushing-up part for moving the cap upwards or downwards by rotating, a cam shaft provided integrally with the pushing-up part as a rotating shaft of the pushing-up part, a cam shaft gear including a drive region, which rotates integrally with the cam shaft taken as a rotating shaft, whereby a driving force of a motor for driving the cam shaft is transmitted, and a non-drive region whereby the driving force of the motor is not transmitted and a driving force transmission gear for transmitting the driving force of the motor to the cam shaft gear in order that the cap can be moved downwards from a state in which the cap has been completely moved upwards, after the motor rotates by a predetermined amount from when the cap has been completely moved upwards, and transmitting the driving force of the motor to the cam shaft gear in order that the cap can be moved upwards from a state in which the cap has been completely moved downwards, after the motor rotates by a predetermined amount from when the cap has been completely moved downwards. Accordingly, the same effect as that of the first aspect of the present invention can be achieved in the liquid ejecting apparatus.

According to the third aspect of the present invention, an ejection characteristics maintaining mechanism for maintaining ejection characteristics of a liquid ejecting head for ejecting liquid to a target, includes a motor for generating a driving force, a conveying part for conveying the target based on the driving force, a cap for sealing the liquid ejecting head, a pump for sucking liquid from the cap and a driving force switching part for stopping transmitting the driving force to the conveying part, moving the cap to seal the liquid ejecting head based on the driving force, and driving the pump to suck liquid from the cap after the cap seals the liquid ejecting head. Accordingly, using the motor for supplying the driving force to the conveying part, the cap and the pump can be driven. Therefore, the number of parts can be reduced as compared with a driving means for driving the cap and the pump separately from the motor for supplying the driving force to the conveying part.

The ejection characteristics maintaining mechanism may further include a wiper for wiping the liquid ejecting head by moving forward onto a movement path of the liquid ejecting head, wherein the driving force switching part may move the wiper onto the movement path of the liquid ejecting head based on the driving force, after stopping transmitting the driving force to the conveying part before driving the pump. Accordingly, using the motor for supplying the driving force to the conveying part, the wiper can be further driven.

The driving force switching part may move the cap to seal the liquid ejecting head, after the wiper is moved forward onto the movement path of the liquid ejecting head. Accordingly, the wiper can wipe the liquid ejecting head in the state where the cap does not seal the liquid ejecting head.

The driving force switching part may move the cap to seal the liquid ejecting head, after a predetermined time from when the wiper is moved forward onto the movement path of the liquid ejecting head. Accordingly, the wiper can wipe the liquid ejecting head more securely in the state where the cap does not seal the liquid ejecting head.

The driving force switching part may drive the pump, after a predetermined time from when the cap seals the liquid ejecting head. Accordingly, the cap can seal the liquid ejecting head more securely in the state where the pump is not driven.

According to the fourth aspect of the present invention, an ejection characteristics maintaining mechanism for maintaining ejection characteristics of a liquid ejecting head for ejecting liquid to a target, includes a motor for generating a driving force by rotating a normal or reverse direction, a conveying part for conveying the target based on the driving force caused by the normal rotation of the motor, a for wiping the liquid ejecting head by moving forward onto a movement path of the liquid ejecting head based on the driving force caused by the reverse rotation of the motor, a cap for sealing the liquid ejecting head based on the driving force caused by the reverse rotation of the motor and a pump for sucking liquid from the cap based on the driving force based caused by the reverse rotation of the motor. Accordingly, with one motor, the driving force can be transmitted to the conveying part, the wiper, the cap and the pump, and the number of parts can be reduced.

The ejection characteristics maintaining mechanism may further include a driving force switching part for stopping transmitting the driving force to the conveying part based on the driving force caused by the reverse rotation when the motor rotates in the reverse direction, then moving the wiper forward onto a movement path of the liquid ejecting head, moving the cap to seal the liquid ejecting head after the wiper is moved forward onto the movement path of the liquid ejecting head and driving the pump to suck liquid from the cap after the cap seals the liquid ejecting head. Accordingly, by rotating one motor in one direction, the wiper, the cap and the pump can be driven sequentially.

The driving force switching part may move the cap to seal the liquid ejecting head, after the motor rotates in the reverse direction by a predetermined amount from when the wiper is moved forward on to the movement path of the liquid ejecting head. Accordingly, the wiper can wipe the liquid ejecting head more securely in the state where the cap does not seal the liquid ejecting head.

The driving force switching part may drive the pump, after the motor rotates in the reverse direction by a predetermined amount from when the cap seals the liquid ejecting head. Accordingly, the cap can seal the liquid ejecting head more securely in the state where the pump is not driven.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
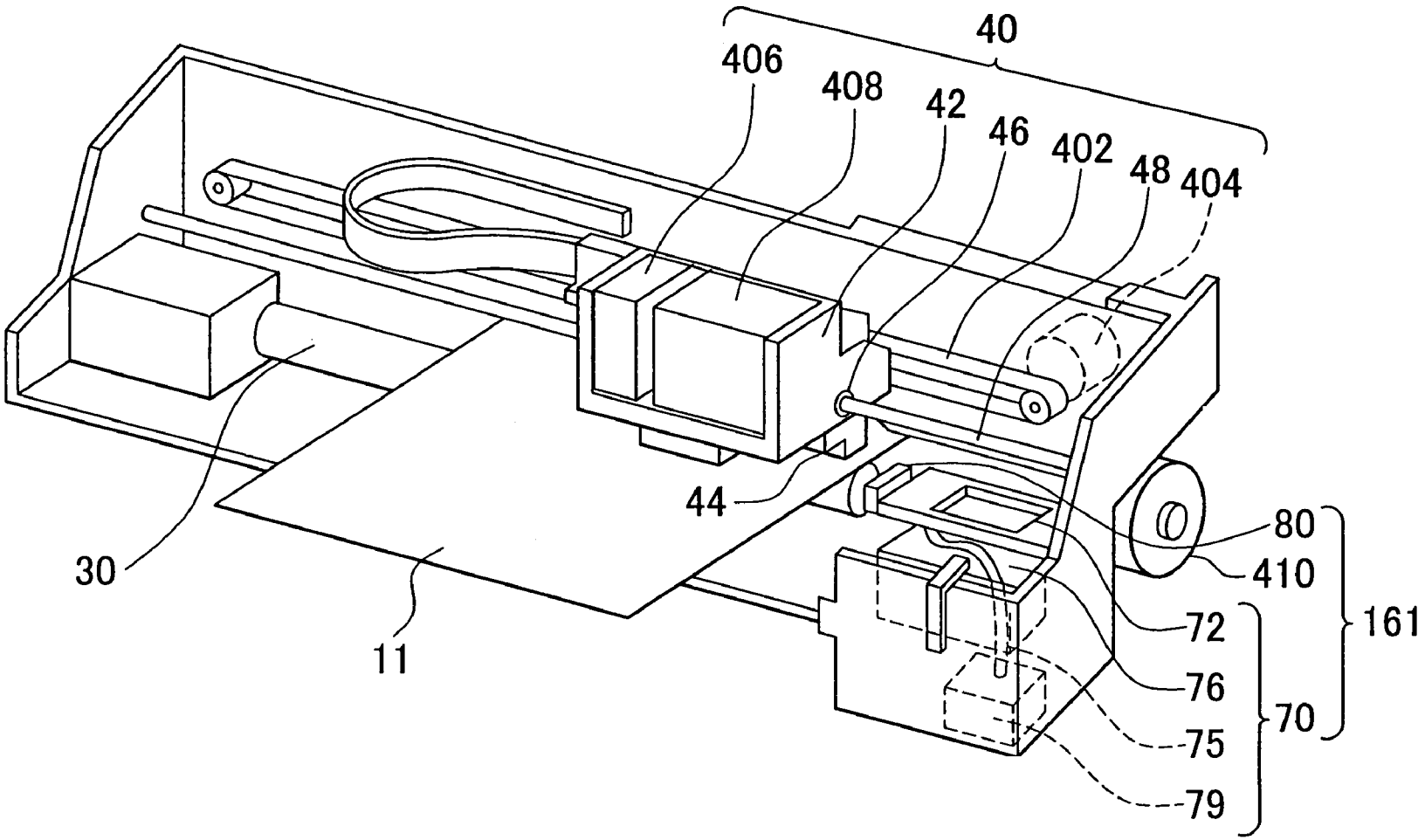
FIG. 1 is a perspective view of an inkjet type recording apparatus.

FIG. 1 is a perspective view of an inkjet type recording apparatus 10. It is an object of the inkjet type recording apparatus 10 of the present invention to drive a wiper, a cap and a pump with a small number of parts. Further, it is another object of the inkjet type recording apparatus 10 to prevent the tooth skipping sound by generating a predetermined time lag with regard to driving the cap and to move the cap smoothly. Here, the inkjet type recording apparatus 10 is an example of a liquid ejecting apparatus. In addition, a recording head of the inkjet type recording apparatus 10 is an example of a liquid ejecting apparatus. A discharge opening provided at the recording head is an example of an ejection opening of the liquid ejecting head. In addition, a medium to be recorded 11 is an example of a target.

The inkjet type recording apparatus 10 includes a recording part 40, a cleaning mechanism 161 and a platen 30. The recording part 40 includes a carriage 42 for carrying an ink cartridge, a recording head 44 provided on a surface of the carriage 42 facing the medium to be recorded 11, a engaging part 46 provided at the carriage 42 and a guide 48 engaged with the engaging part 46 for supporting the carriage 42 being slidable in a direction substantially perpendicular to a feed direction. In addition, the recording head 44 includes a plurality of discharge openings arranged along the feed direction of the medium to be recorded 11. The recording part 40 further includes a timing belt 402, a carriage motor 404, a black ink cartridge 406 and a color ink cartridge 408. Here, the cleaning mechanism 161 is an example of an ejection characteristics maintaining mechanism of the present invention.

In the inkjet type recording apparatus 10 above, as the carriage motor 404 drives the timing belt 402, the carriage 42 is reciprocatively moved in a direction substantially perpendicular to the feed direction of the medium to be recorded 11 while guided by the guide shaft 48. At a side of the carriage 42 facing the medium to be recorded, the recording head 44 is attached where the discharge openings for black and color ink are formed on a discharge opening-formed surface. On an upper part of the carriage 42, the black ink cartridge 406 and the color ink cartridge 408 are detachably mounted for supplying ink to the recording head 44. The motor 410 drives the platen 30. The platen 30 feeds the medium to be recorded 11 to the recording part 40 and discharges the medium 11 which has been recorded.

The cleaning mechanism 161 includes a wiper 80 for wiping the discharge opening-formed surface of the recording head 44 in order to maintain the ejection characteristics of the recording head 44 and an ink conveying part 70 for conveying the ink discharged from the recording head 44. The ink conveying part 70 includes a cap 72 for sealing the discharge opening-formed surface of the recording head 44, a tube 75 for conveying the ink ejected to the cap 72 from the discharge openings, a pump 76 for conveying the ink inside the tube by elastically deforming a part of the tube and a waste ink box 79 for accumulating the ink conveyed by the pump 76, these elements disposed in an order of a conveyance direction of ink. The ink conveying part 70 is arranged in a non-recording region (home position) outside a recording region (the feed direction of the medium to be recorded 11). The wiper 80 has elasticity and is arranged near an end part of the recording region-side of the cap 72.

In the configuration as above, when the inkjet type recording apparatus 10 does not perform recording, the carriage 42 moves from the recording region to the non-recording region. When the recording head 44 provided at the carriage 42 is moved inwards directly over the cap 72, the cap 72 is raised toward the carriage 42 so that it can seal the discharge opening-formed surface of the recording head 44. Here, in this sealing state, the pump 76 sucks the air inside a space formed by the recording head 44 and the cap, so that the ink can be compulsorily sucked and discharged from the discharge openings of the recording head 44, and thus the discharge opening can be cleaned.

Further, the cap 72 seals the discharge opening-formed surface of the recording head 44, and thus the discharge openings can be prevented from drying. In addition, the cap 72 receives the ink idly ejected during flushing when ink drops are idly ejected from the recording head 44. This flushing is performed by applying a drive signal irrelevant to recording to the recording head 44 and the discharge openings of the recording head 44 can be prevented from drying. When the carriage 42 returns to the recording region from the non-recording region, it is first separated from the cap 72. Further, as the carriage 42 is moved toward the non-recording region, the wiper 80 is moved forward onto a movement path of the recording head 44 to wipe the ink on the discharge opening-formed surface of the recording head 44.

Figure 2:
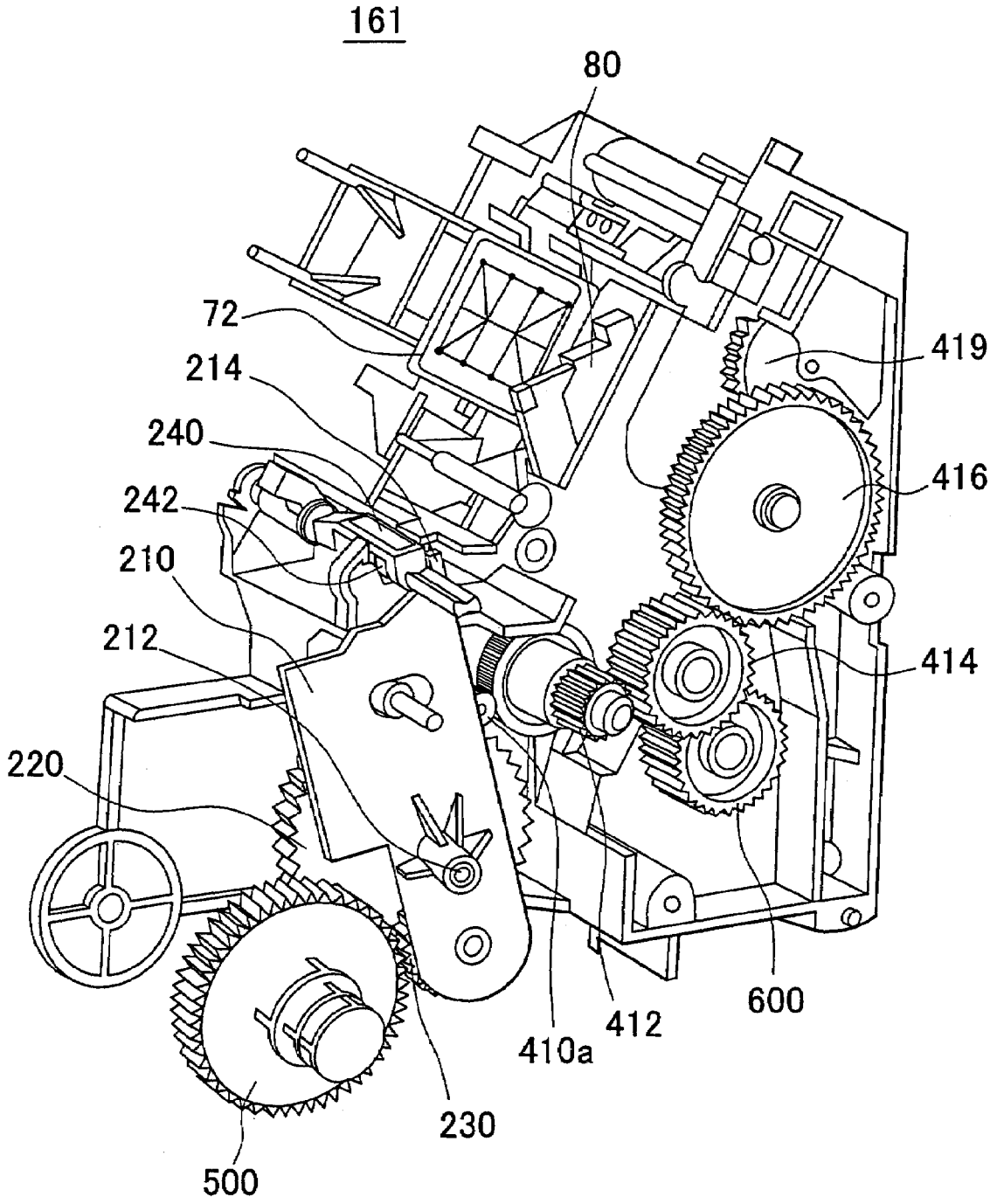
FIG. 2 is a front perspective view showing an appearance of a cleaning mechanism.

FIG. 2 is a perspective view showing an appearance of a cleaning mechanism 161. In the cleaning mechanism 161 shown in FIG. 2, the cap 72 is installed obliquely to a vertical direction. The cleaning mechanism 161 includes a motor shaft gear 410*a* fixed to a motor 410 for generating the driving force by rotating in normal and reverse directions, a sun gear 220 always engaged with the motor shaft gear 410*a*, a planetary gear 230 engaged with the sun gear 220, a planetary lever 210 for holding the planetary gear 230 by constantly keeping a distance between the sun gear 220 and the planetary gear 230 and a conveying part 500 being rotated based on the driving force caused by the normal rotation of the cleaning mechanism 161. The planetary lever 210 engages or separates the planetary gear 230 with or from the conveying part 500 by rotating around the rotating shaft 212 of the sun gear 220. In FIG. 2, the motor 410 is rotating normally, and the planetary gear 230 is in a state of being engaged with the conveying part 500. Here, the conveying part 500 holds the platen 30 shown in FIG. 1, and conveys the medium to be recorded 11 using the driving force caused by the normal rotation of the motor 410.

In addition, the cleaning mechanism 161 has a lock lever 240. The lock lever 240 is a cylinder-shaped member having a U-shaped groove part 242 at the center thereof. The lock lever 240, in a usual state, is positioned at a locking position where an engaging projection 214 of the planetary lever 210 is locked at a cylindrical part outside the groove part 242. Due to this, the rotation of the planetary lever 210 is controlled, so that a state where the planetary gear 230 and the conveying part 500 are engaged with each other can be maintained. In addition, the lock lever 240 is moved in a horizontal direction by being pushed in from the carriage 42, and the groove part 242 is moved to a releasing position facing the engaging projection 214.

The cleaning mechanism 161 further includes a first gear 412 always engaged with the motor shaft gear 410*a*, a second gear 414 always engaged with the first gear 412, a third gear 416 always engaged with the second gear 414 and a drive transmission gear 419 always engaged with the third gear 416. The motor shaft gear 410*a*, the first gear 412, the second gear 414 and the third gear 416 transmit the driving force of the motor 410 to the drive transmission gear 419 which drives the cap 72. The driving force caused by the reverse rotation of the motor 410 is transmitted to the drive transmission gear 419, and thus the cap 72 is driven and moved by the drive transmission gear 419 so that it can seal the recording head 44.

The cleaning mechanism 161 further includes a pump driving mechanism 600 for driving the pump 76 for sucking liquid from the cap 72 based on the driving force caused by the reverse rotation of the motor 410. The pump driving mechanism 600 is engaged with the second gear 414, so that the driving force of the motor 410 can be transmitted. Moreover, the cleaning mechanism 161 includes a wiper moving mechanism 300 for driving the wiper 80 based on the driving force from the drive transmission gear 419, and the wiper moving mechanism 300 will be described in relation to FIG. 8.

Figure 3:
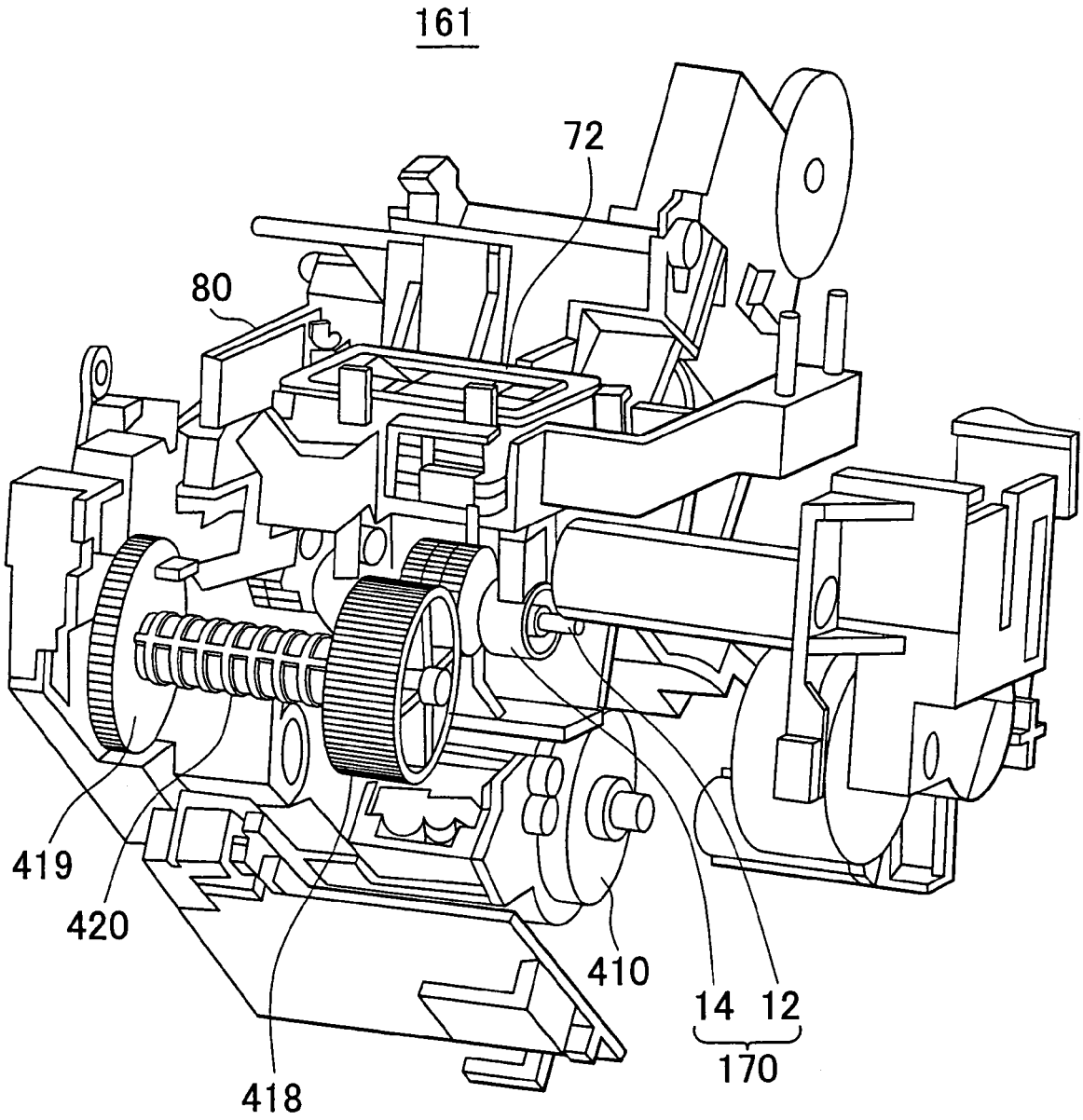
FIG. 3 shows an example of the internal configuration of a cleaning mechanism.

FIG. 3 shows an example of the internal configuration of the cleaning mechanism 161. The drive transmission gear 419 is arranged at one end of a cap driving shaft 420. At the other end of the cap driving shaft 420, a cap driving gear 418 is arranged. These drive transmission gear 419, cap driving shaft 420 and cap driving gear 418 are integrally rotated. The cleaning mechanism 161 includes a cap moving mechanism 170 in order to drive the cap 72. The drive transmission gear 419 transmits the driving force of the motor 410 to the cap moving mechanism 170 by being engaged with a part of a gear constituting the cap moving mechanism 170.

The cap moving mechanism 170 includes a cam shaft 12 and a pushing-up part 14. The cap moving mechanism 170 rotates the cam shaft 12 and the pushing-up part 14 using the driving force of the motor 410 transmitted from the cap driving gear 418. The pushing-up part 14 is in contact with the cap 72 arranged over it, and moves the cap 72 up and down by pushing up the cap 72 while rotating. Further, the planetary lever 210, the sun gear 220, the planetary gear 230, the wiper moving mechanism 300, the cap moving mechanism 170 and the pump driving mechanism 600 shown in FIGS. 2 and 3 are an example of a driving force switching part relating to the present invention.

Figure 4:
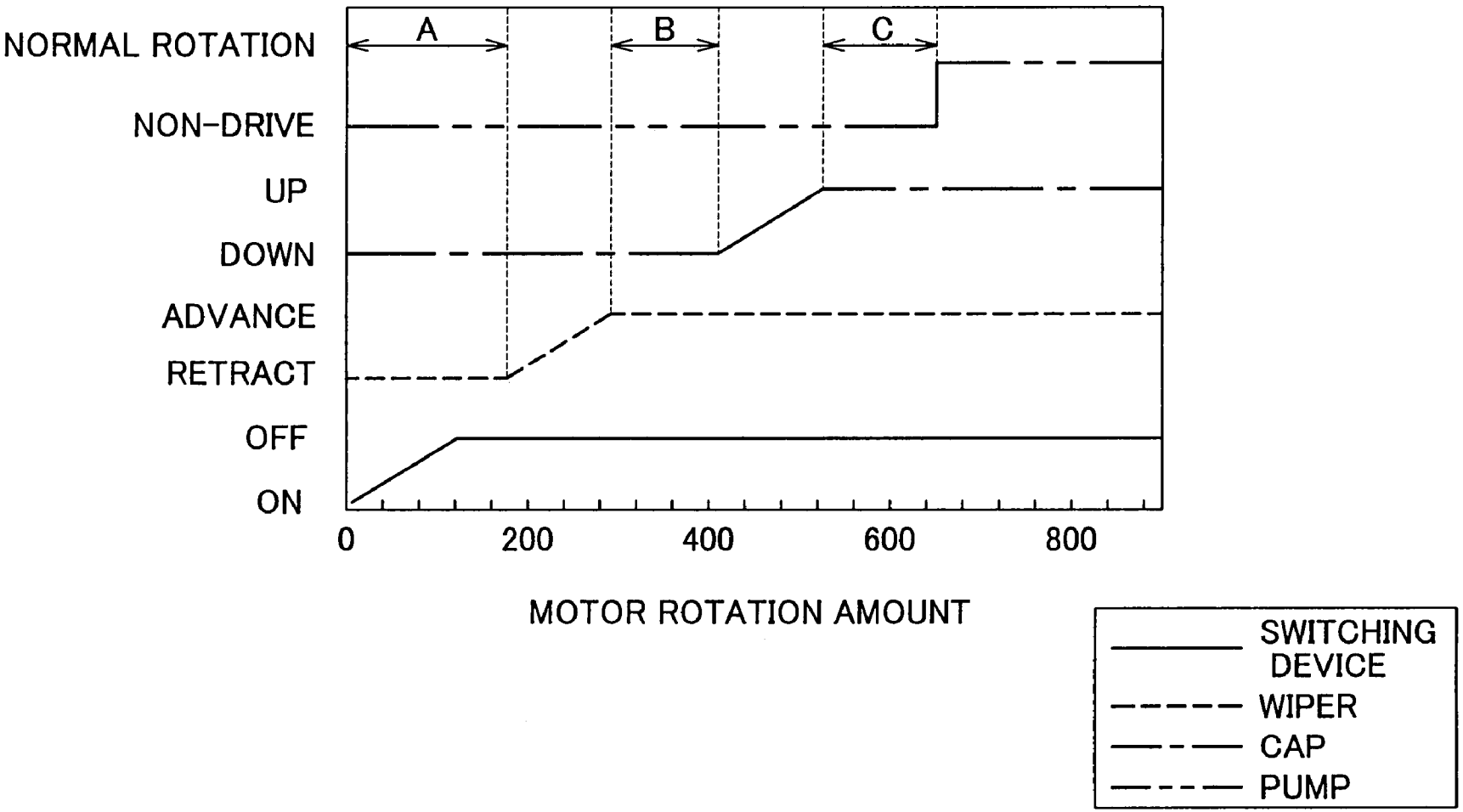
FIG. 4 is a timing chart of a cleaning mechanism.

FIG. 4 is a timing chart showing the operation of the cleaning mechanism 161 in case the motor 410 rotates in a reverse direction. In a state where the recording head 44 performs recording on the medium to be recorded 11, the cleaning mechanism 161 does not operate. In this case, the motor 410 rotates in the normal direction, the driving force of the motor 410 as shown in FIG. 2 is transmitted to the conveying part 500 and the conveying part 500 conveys the medium to be recorded 11.

When the recording head 44 finishes recording, the cleaning mechanism 161 starts to operate as the recording head 44 is moved toward the cleaning mechanism 161. First, the recording head 44 moves the lock lever 240 to the releasing position. At this state, as the motor 410 rotates in the reverse direction, the planetary gear 230 is rotated around the sun gear 220 by the driving force of the motor 410 so that the planetary lever 210 can be rotated. Due to this, the planetary gear 230 is separated from the conveying part 500, and the driving force stops being transmitted to the conveying part 500. Then, as the recording head 44 is separated from the lock lever 240, the lock lever 240 returns to the locking position, so that the state where the driving force stops being transmitted to the conveying part 500 can be maintained. Here, while the planetary lever 210 is rotating, the cleaning mechanism 161 does not drive the wiper 80, the cap 72 and the pump 76. Therefore, this time interval is time lag A.

If the motor 410 further rotates in the reverse direction, the wiper moving mechanism 300 moves the wiper 80 onto the movement path of the recording head 44 by the driving force of the motor 410. From when the wiper 80 moves forward onto the movement path of the liquid ejecting head to when the motor 410 further rotates by a predetermined amount in the reverse direction, the cleaning mechanism 161 does not drive the cap 72 and the pump 76. Therefore, this time interval is time lag B. In the state where the rotation of the motor 410 is stopping rotation during the time lag B, as the recording head 44 is moved scanning relatively to the wiper 80, the wiper 80 wipes the discharge opening-formed surface of the recording head 44. When the recording head 44 is moved scanning, the cap 72 is not driven and moved upwards, so that it can prevented from colliding with the recording head 44.

After this, as the motor 410 further rotates in the reverse direction, the cap moving mechanism 170 moves the cap 72 upwards to seal the recording head 44 by the driving force of the motor 410. From when the cap 72 seals the recording head 44 to when the motor 410 further rotates by a predetermined amount in the reverse direction, the cleaning mechanism 161 does not drive the pump 76. Therefore, this time interval is time lag C. As the rotation of the motor 410 is stopped during the time lag C, the cap 72 seals the discharge opening-formed surface of the recording head 44 in the state where suction is not performed by the pump 76.

And then, as the motor 410 further rotates in the reverse direction, the pump driving mechanism 600 drives the pump 76. Due to this, in the state where the cap 72 seals the discharge opening-formed surface of the recording head 44, the pump driving mechanism 600 sucks the ink from the discharge openings of the recording head 44 compulsorily to clean the discharge openings.

Figure 5:
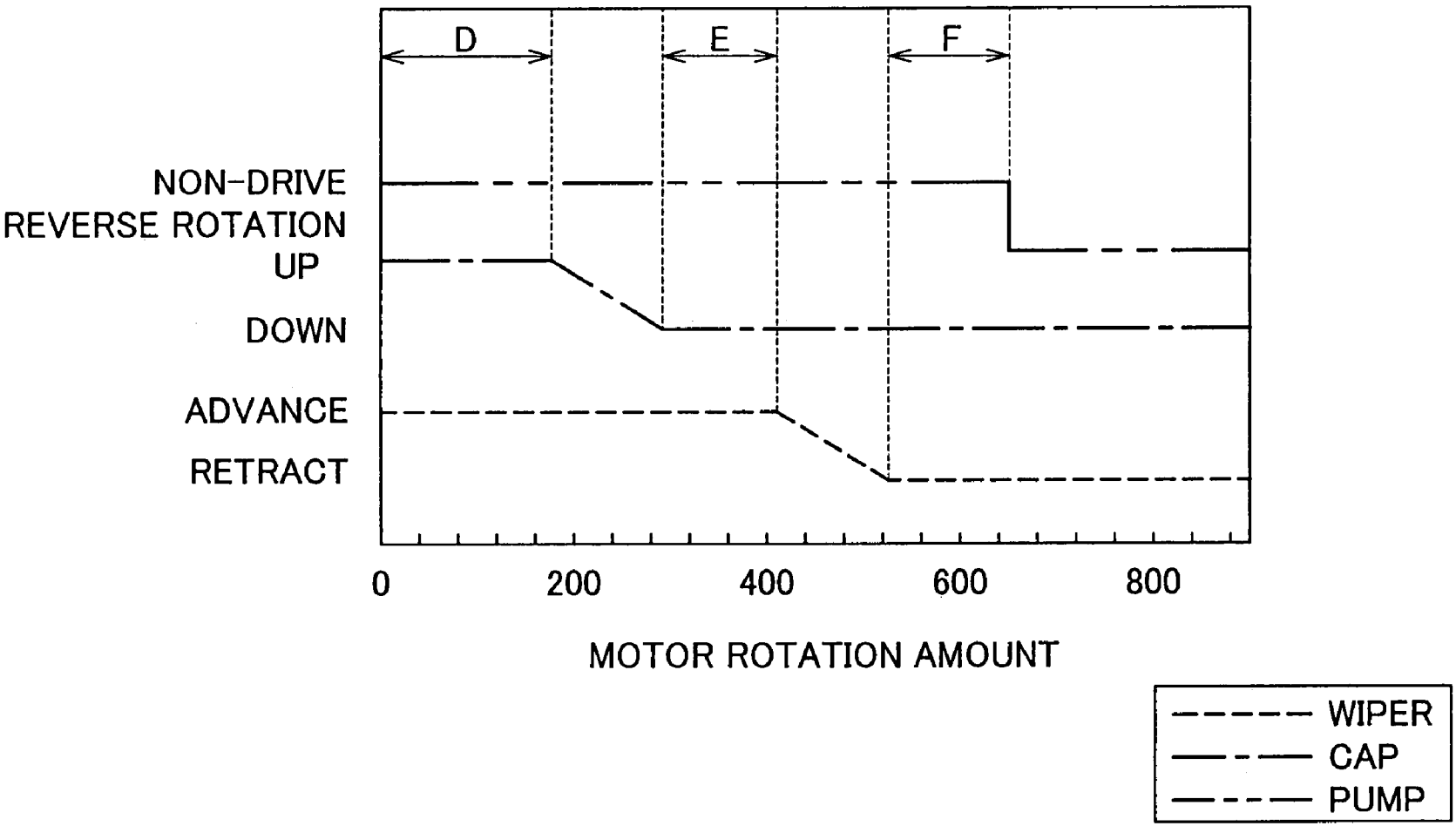
FIG. 5 is a timing chart of a cleaning mechanism.

FIG. 5 is a timing chart showing the operation of the cleaning mechanism 161 in case the motor 410 rotates in the normal direction while the pump 76 is driven. When the cleaning mechanism 161 finishes operating, the motor 410 rotates in the normal direction. As the motor 410 changes the reverse rotation to the normal rotation, the pump driving mechanism 600 stops driving the pump 76. In this case, until the motor 410 rotates in the normal direction by a predetermined amount, the cleaning mechanism 161 does not move the wiper 80 and the cap 72. Therefore, this time interval is time lag D.

As the motor 410 further rotates in the normal direction, the cap moving mechanism 171 moves the cap 72 downwards to separate it from the recording head 44 by the driving force of the motor 410. From when the cap 72 is separated from the recording head 44 to when the motor 410 further rotates in the normal direction by a predetermined amount, the cleaning mechanism 161 does not drive the wiper 80. Therefore, this time interval is time lag E.

And then, as the motor 410 further rotates in the normal direction, the wiper moving mechanism 300 moves the wiper 80 to retract it from the movement path of the recording head 44 by the driving force of the motor 410. From when the wiper 80 is retracted from the movement path of the recording head 44 to when the motor 410 further rotates in the normal direction by a predetermined amount, the cleaning mechanism 161 does not drive the pump 76. Therefore, this time interval is time lag F. And then, as the motor 410 further rotates in the normal direction, the pump driving mechanism 600 drives the pump 76 in the reverse direction.

By the configuration as above, it is possible to drive the wiper 80, the cap 72 and the pump 76 sequentially using one motor 410 supplying the driving force to the conveying part 500. Therefore, the number of the parts can be reduced as compared with a driving means for driving the wiper 80, the cap 72 and the pump 76 separately from the motor 410 supplying the driving force to the conveying part 500.

In addition, since the time lag is provided between driving the wiper 80 and the cap 72, the wiper 80 can wipe the recording head 44 more accurately in the state where the cap 72 seals the recording head 44. Further, since the time lag is provided between driving the cap 72 and the pump 76, the cap can seal the liquid ejecting head more accurately in the state where the pump is not driven.

Figure 6:
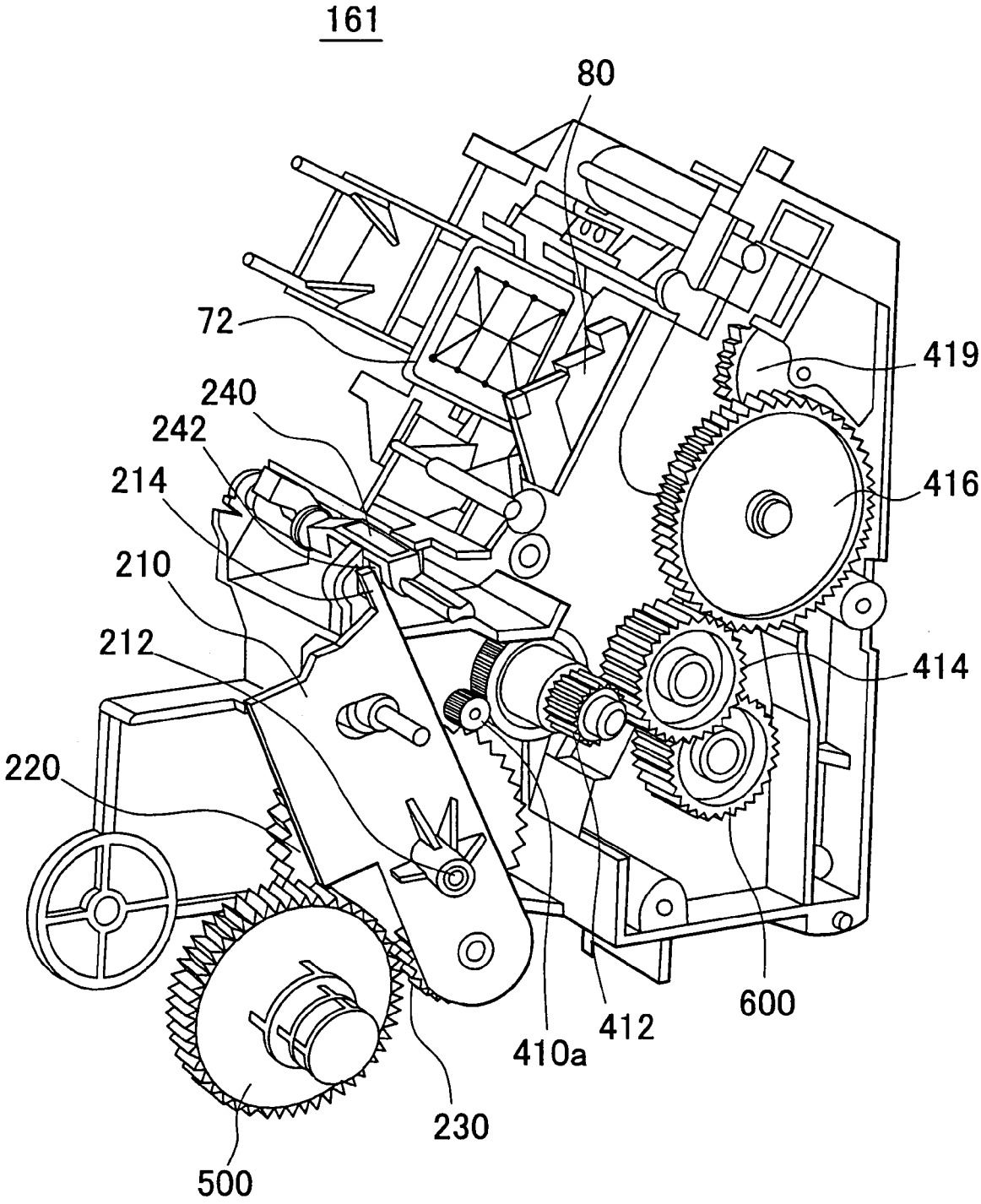
FIG. 6 is a front perspective view showing an appearance of a cleaning mechanism.
Figure 7:
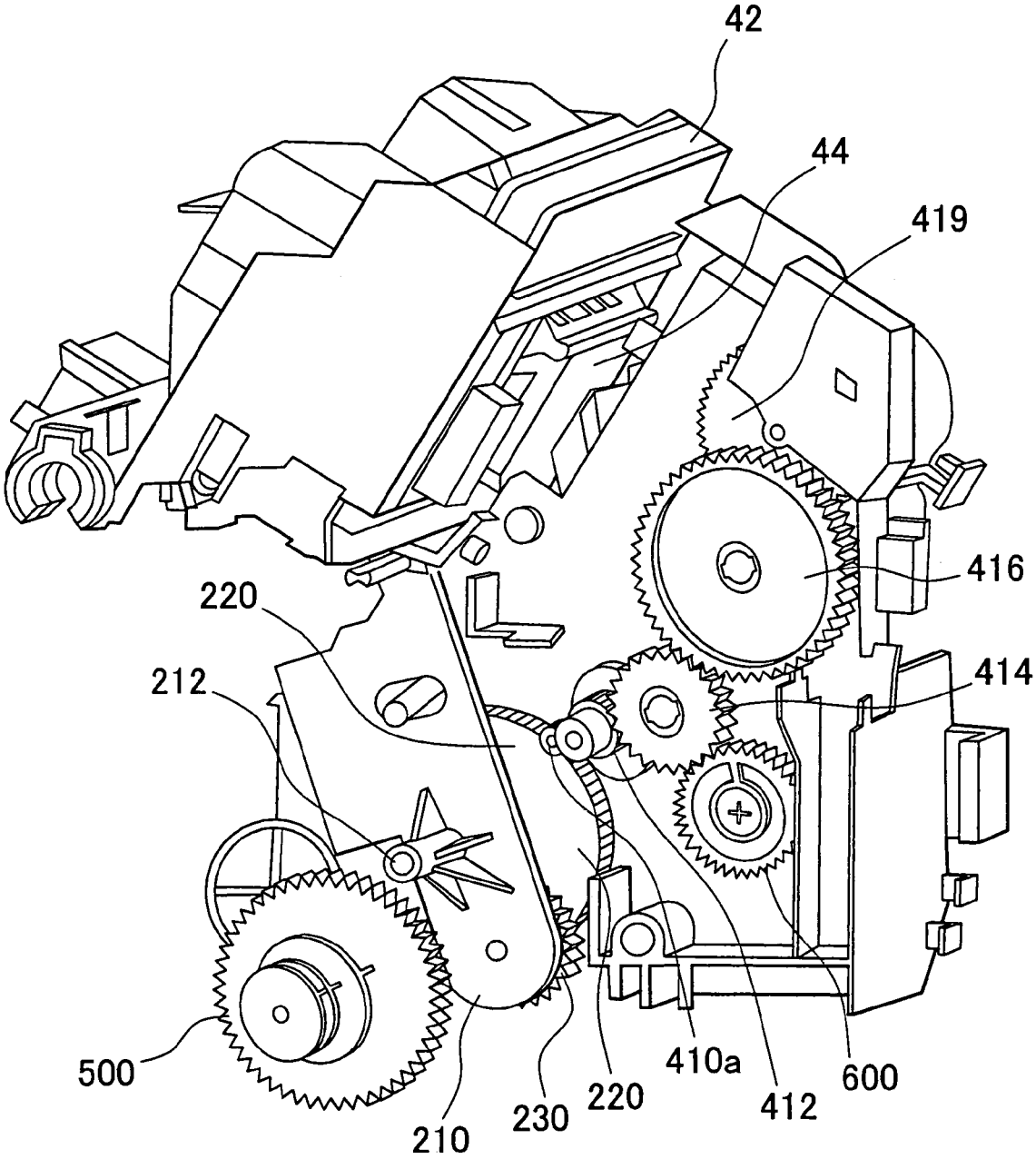
FIG. 7 is a rear perspective view showing an appearance of a cleaning mechanism.

FIG. 6 is a perspective view of the cleaning mechanism 161, and shows a state where the planetary gear 230 is disengaged from the conveying part 500. FIG. 7 is a rear perspective view of the cleaning mechanism 161 in FIG. 6. When the motor 410 rotates in the reverse direction from the state where it rotates in the normal direction shown in FIG. 2, the driving force of the motor 410 stops being transmitted to the conveying part 500. Due to this, the carriage 42 first moves the lock lever 240 to the releasing position. Accordingly, the engaging projection 214 of the planetary lever 210 passes through the groove 242 of the lock lever 240, and the planetary lever 210 can be rotated around the rotating shaft 212. In this state, as the motor 410 rotates in the reverse direction, the driving force in this reverse direction is transmitted to the sun gear 220, the planetary gear 230 fitted with the planetary lever 210 is rotated over the sun gear 220 and the planetary lever 210 is rotated in a direction to separate the planetary gear 230 from the conveying part 500. And then, as the recording head 44 is separated from the lock lever 240 and the lock lever 240 returns to the locking position, the engaging projection 214 of the planetary lever 210 is locked by the lock lever 240, the rotation of the planetary lever 210 is controlled, and then the state where the conveying part 500 is detached from the driving force of the motor 410 is maintained.

In addition, when the motor 410 rotates in the normal direction from the state shown in FIG. 6 to transmit the driving force to the conveying part 500, the carriage 42 first moves the lock lever 240 to the releasing position. Due to this, the engaging projection 214 of the planetary lever 210 passes through the groove 242 of the lock lever 240, and the planetary lever 210 comes into a state where it is rotated around the rotating shaft 212. In this state, as the motor 410 rotates in the normal direction, the driving force in the reverse direction is transmitted to the sun gear 220, then the planetary gear 230 fitted with the planetary lever 210 is rotated over the sun gear 220 and then the planetary lever 210 is rotated in a direction to engage the planetary gear 230 with the conveying part 500. And then, as the recording head 44 is separated from the lock lever 240 and the lock lever 240 returns to the locking position, the engaging projection 214 of the planetary lever 210 is locked by the lock lever 240, the rotation of the planetary lever 210 is controlled and the state where the driving force of the motor 410 is transmitted to the conveying part 500 is maintained.

Figure 8:
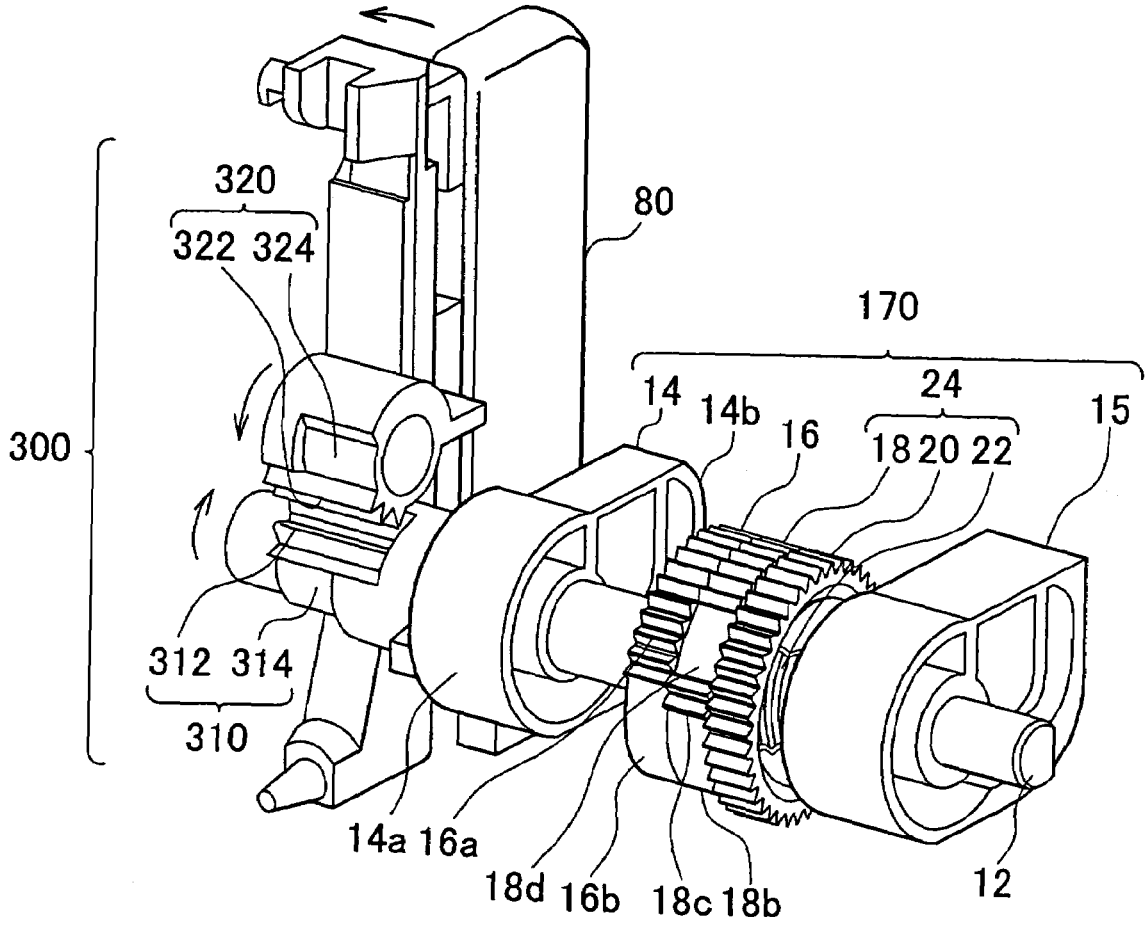
FIG. 8 is a perspective view of a cap moving mechanism and a wiper moving mechanism.

FIG. 8 shows an example of the detailed configuration of the cap moving mechanism 170 and the wiper moving mechanism 300. The cap moving mechanism 170 includes a cam shaft 12, a pushing-up parts 14 and 15, a cam shaft gear 16 and a driving force transmission gear 24. The pushing-up part 14, which is shaped like a cam, rotates being in contact with the cap 72 arranged above it so that it can moves the cap 72 up and down. The cam shaft 12 is provided integrally with the pushing-up part 14 as a rotating shaft of the pushing-up part 14. The cam 14 includes a circumferential part 14*a* the radius of which is constant and a projection part 14*b* which projects in a radius direction more than the circumferential part 14*a*. Further, a part of the pushing-up part 15 in the right side of FIG. 8 is shown as broken lines for the sake of description. In addition, FIG. 8 shows a state where the wiper moving mechanism 300 retracts the wiper 80 from the movement path of the recording head 44 while the cap moving mechanism 170 has completely moved the cap 72 downwards.

The cam shaft gear 16 is provided integrally with the cam shaft 12 taking the cam shaft 12 as a rotating shaft. The cam shaft gear 16 has a drive region 16*a* by which the driving force of the motor 410 is transmitted and a non-drive region 16*b* by which the driving force of the motor 410 is not transmitted. The drive region 16*a* has teeth for transmitting the driving force of the motor 410. On the other hand, the non-drive region 16*b* does not have any teeth, so that the driving force of the motor 410 cannot be transmitted.

The driving force transmission gear 24 includes a toothed gear 18, a spur gear 20 and an energizing part 22. The toothed gear 18 includes two non-drive regions 18*b* and 18*d* by which the driving force of the motor 410 is not transmitted and drive regions 18*a* and 18*c*, held between the two non-drive regions 18*b* and 18*d*, by which the driving force of the motor 410 is transmitted. The drive regions 18*a* and 18*c* have teeth for transmitting the driving force of the motor 410. On the other hand, the non-drive regions 18*b* and 18*d* do not have any teeth, so that they cannot transmit the driving force of the motor 410.

At the state where the cap 72 has been completely moved upwards and the state where the cap 72 has been completely moved downwards, since the non-drive regions 18*b* and 18*d* of the toothed gear 18 are arranged at a position facing the cap driving gear 418, the driving force of the motor 410 is not transmitted to the cam shaft 12. Therefore, the toothed gear 18 is not engaged with the cap driving gear 418 and it is not rotated by the driving force of the cap driving gear 418, so that the tooth skipping sound can be prevented. Further, when the cap 72 is moved upwards from the state where it has been completely moved downwards, the drive region 18*a* or 18*c* of the toothed gear 18 is arranged at a position facing the cap driving gear 418, and thus the driving force of the motor 410 can be transmitted to the cam shaft 12.

The spur gear 20 is in contact with the toothed gear 18. The spur gear 20 is rotated taking the cam shaft 12 as an axis. The spur gear 20, however, is not combined with the cam shaft 12, so that it can be rotated freely to the cam shaft 12 receiving the driving force of the motor 410. Since the spur gear 20 is rotated freely to the cam shaft 12 and always engaged with the cap driving gear 418, the tooth skipping sound does not occur due to the spur gear 20. The energizing part 22 energizes the spur gear 20 against the toothed gear 18, so that it can transmit the rotating force of the spur gear 20 to the toothed gear 18. Therefore, the spur gear 20 is rotated accompanying the toothed gear 18. Due to this, even if the toothed gear 18 is at the non-drive region 18*b* not receiving the driving force of the motor 410, the toothed gear 18 is rotated accompanying the rotation of the spur gear 22. The toothed gear 18 is arranged between the cam shaft gear 16 and the spur gear 20.

Due to this, during a predetermined time period when the drive regions 18*a* and 18*c* are engaged with the cap driving gear 418 while the toothed gear 18 is rotated accompanying the spur gear 20, the driving force of the motor can be transmitted to the cap shaft 12. In addition, since the driving force of the motor is not transmitted to the cap shaft 12 while the non-drive regions 18*b* and 18*d* are at a position facing the cap driving gear 418 as the toothed gear 18 is rotated accompanying the rotation of the spur gear 20, it is possible to generate a time lag which is a time period when the pushing-up part 14 is not moved.

Therefore, the driving force transmission gear 24 can transmit the driving force of the motor 410 to the cam shaft gear 16 after the motor 410 rotates by a predetermined amount from when the cap 72 has been completely moved upwards in order that the cap 72 is moved downwards from the state where it has been completely moved upwards. Further, the driving force transmission gear 24 can transmit the driving force of the motor 410 to the cam shaft gear 16 after the motor 410 rotates by a predetermined amount from when the cap 72 has been completely moved downwards in order that the cap 72 is moved upwards from the state where it has been completely moved downwards.

In other words, the driving force transmission gear 24 can transmit the driving force of the motor 410 to the cam shaft gear 16 during a predetermined time period or not. Therefore, if the driving force of one motor 410 is used for an operation other than moving the cap 72, the driving force transmission gear 24 can allow the driving force of the motor 410 not to be transmitted to the cam shaft gear 16 during the time period when the motor 410 is used for an operation other than moving the cap 72. Accordingly, the tooth skipping sound, which occurs because engaged teeth are rotated in a direction opposite to each other, can be prevented by disengaging those teeth. In addition, the spur gear 20 is rotated freely to the cam shaft 12, so that the tooth skipping sound caused by the spur gear 20 does not occur.

The cap moving mechanism 170 includes at least two pushing-up parts 14. The cam shaft gear 16, the toothed gear 18, the spur gear 20 and the energizing part 22 are arranged between the two pushing-up parts 14. As the cap 72 is moved up and down using the two pushing-up parts 14 separated from each other by a predetermined distance, the weight of the cap 72 applied to one pushing-up part 14 is reduced and thus the cap 72 can be supported with stability.

In addition, the wiper moving mechanism 300 includes a wiper driving gear part 310 provided at the cam shaft 12 and a wiper driven gear part 320 fixed to the wiper 80 and rotated receiving the driving force from the wiper driving gear part 310. The wiper driving gear part 310 includes a drive region 312 provided integrally with the cam shaft 12 and having a plurality of teeth and a non-drive region 314 which is flat. The wiper driven gear part 320 includes a drive region 322 having a plurality of teeth and a non-drive region 324 which is flat.

Due to this, when the cam shaft 12 is rotated in a direction of the directing arrow shown in FIG. 8 from the state in FIG. 8, the drive region 312 of the wiper driving gear part 310 and the wiper driven gear part 320 of the wiper driven gear part 320 are engaged with each other, the wiper driven gear part 320 is rotated, and thus the wiper 80 is raised upwards and moved forward onto the movement path of the recording head 44. And then, since the non-drive region 314 of the wiper driving gear part 310 and the non-drive region 324 of the wiper driven gear part 320 are facing each other even though the cam shaft 12 is further rotated, the driving force of the rotation is not transmitted so that the position of the wiper 80 can be maintained.

Figure 9:
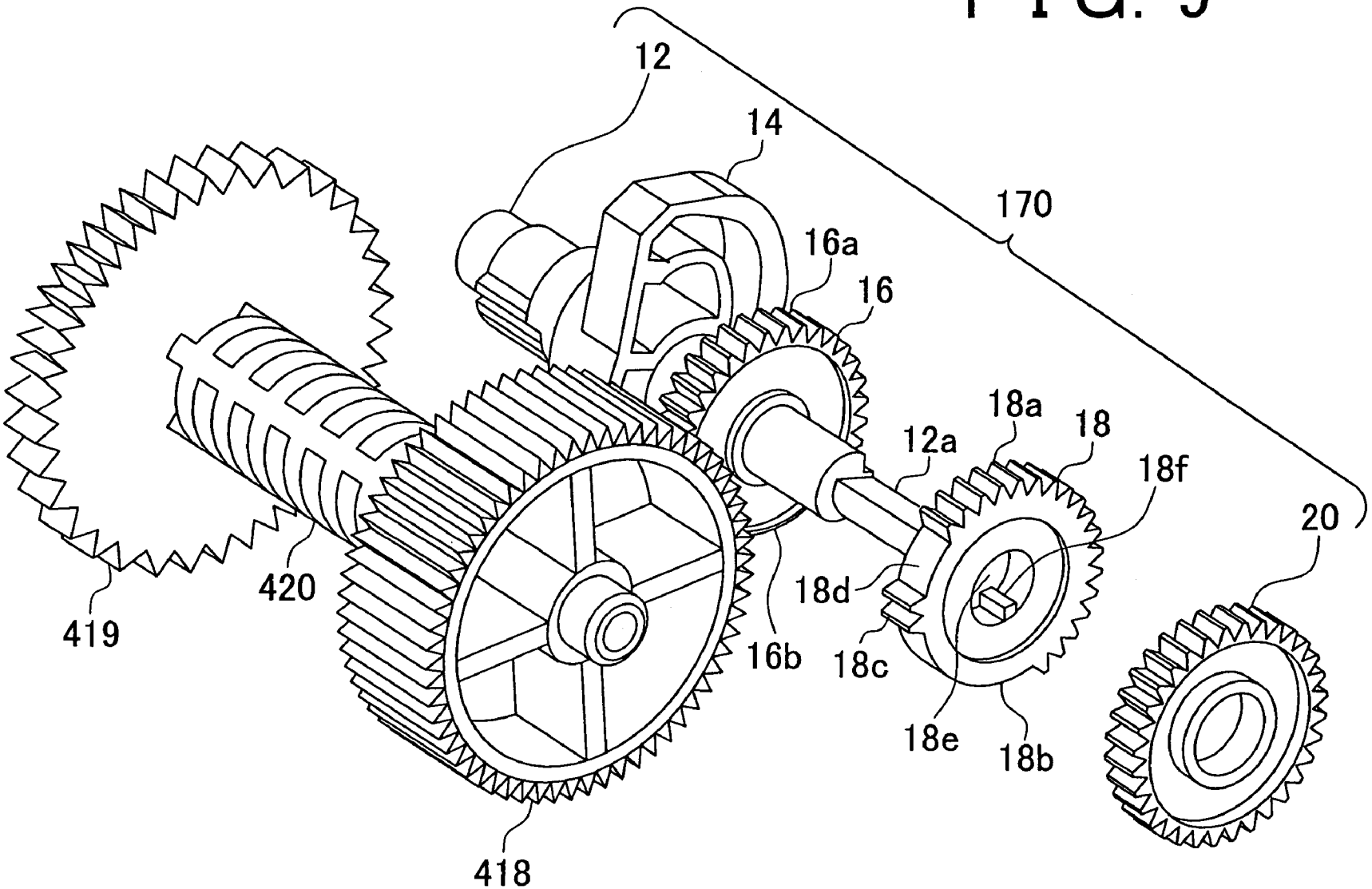
FIG. 9 is an exploded view of the cap moving mechanism.

FIG. 9 shows an example of the exploded view of the cap moving mechanism 170. The toothed gear 18 includes a projection part 18*f* provided in a shaft hole 18*e*. Meanwhile, the cam shaft 12 includes an engaging part 12*a* where a part of the cam shaft 12 lacks along the axis direction. Since a part of the cam shaft 12 lacks along the axis direction, the toothed gear 18 can be moved freely until the projection part 18*f* is engaged with the cam shaft 12. When the projection part 18*f* is engaged with the cam shaft 12 while the toothed gear 18 is being rotated, the toothed gear 18 rotates the cam shaft 12 so that it can transmit the driving force of the motor 410 to the cam shaft 12. In this way, the toothed gear 18 has a play capable of rotating freely by a predetermined angle to the cam shaft 12. Due to this, the toothed gear 18 is idling without being engaged with the cam shaft 12 during a predetermined time period, so that it can allow the driving force of the motor 410 not to be transmitted to the cam shaft 12. Therefore, the toothed gear 18 can generate a predetermined time lag.

Further, the drive region 18*a* or 18*c* of the toothed gear 18 is arranged at least at a part of an angle area where the non-drive region 16*b* of the cam shaft gear 16 is arranged with regard to the cam shaft 12. Due to this, during the time period when the driving force of the motor 410 is not transmitted to the cam shaft gear 16, the driving force of the motor 410 can be transmitted to the toothed gear 18.

Figure 10:
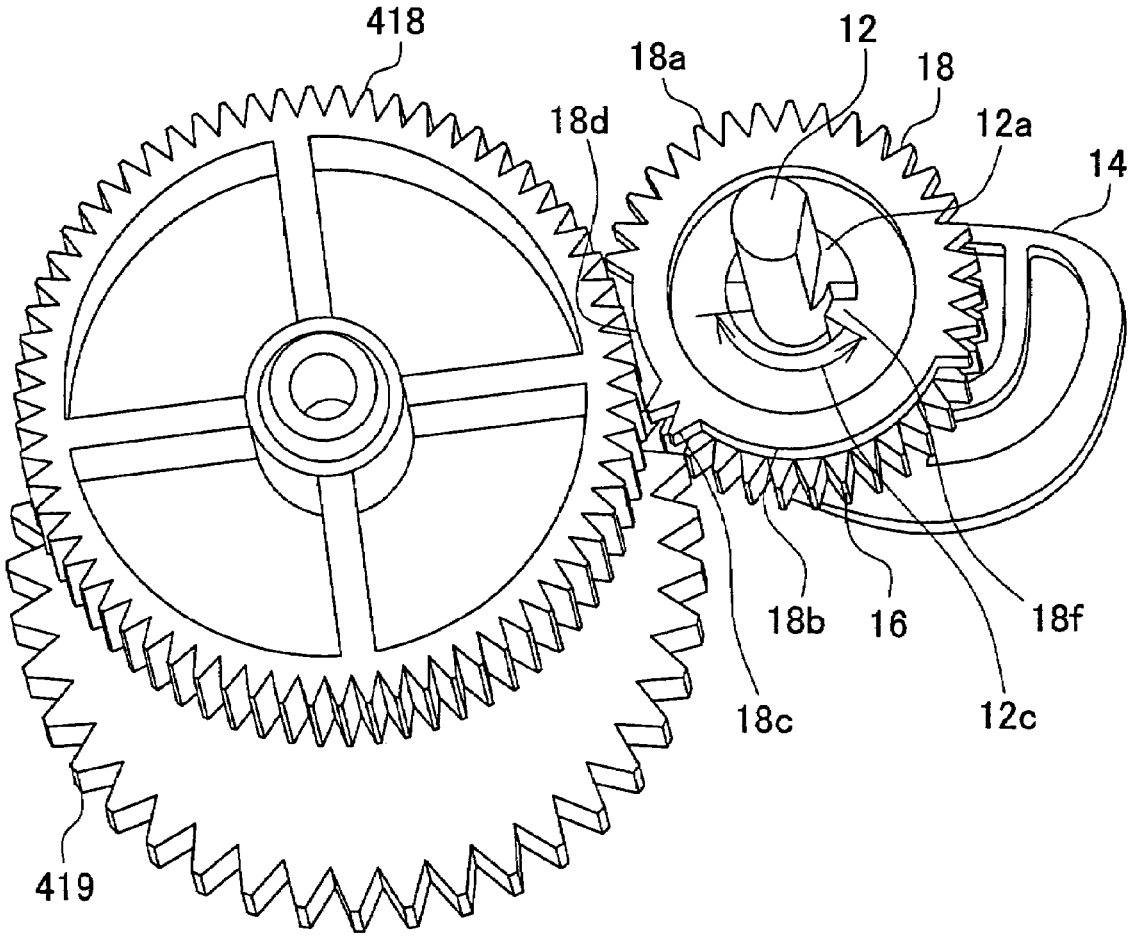
FIG. 10 shows a state where a cap has been completely moved downwards.

FIG. 10 shows an example of the position relation between the cap moving mechanism 170 and the cap driving gear 418 in the state where the cap 72 has been completely moved downwards. In this state, the non-drive region 18*d* of the toothed gear 18 is facing the cap driving gear 418, and the driving force of the cap driving gear 418 is not transmitted to the toothed gear 18. Further, the spur gear 20 will not be shown in FIGS. 10 to 15 for the sake of description.

Figure 11:
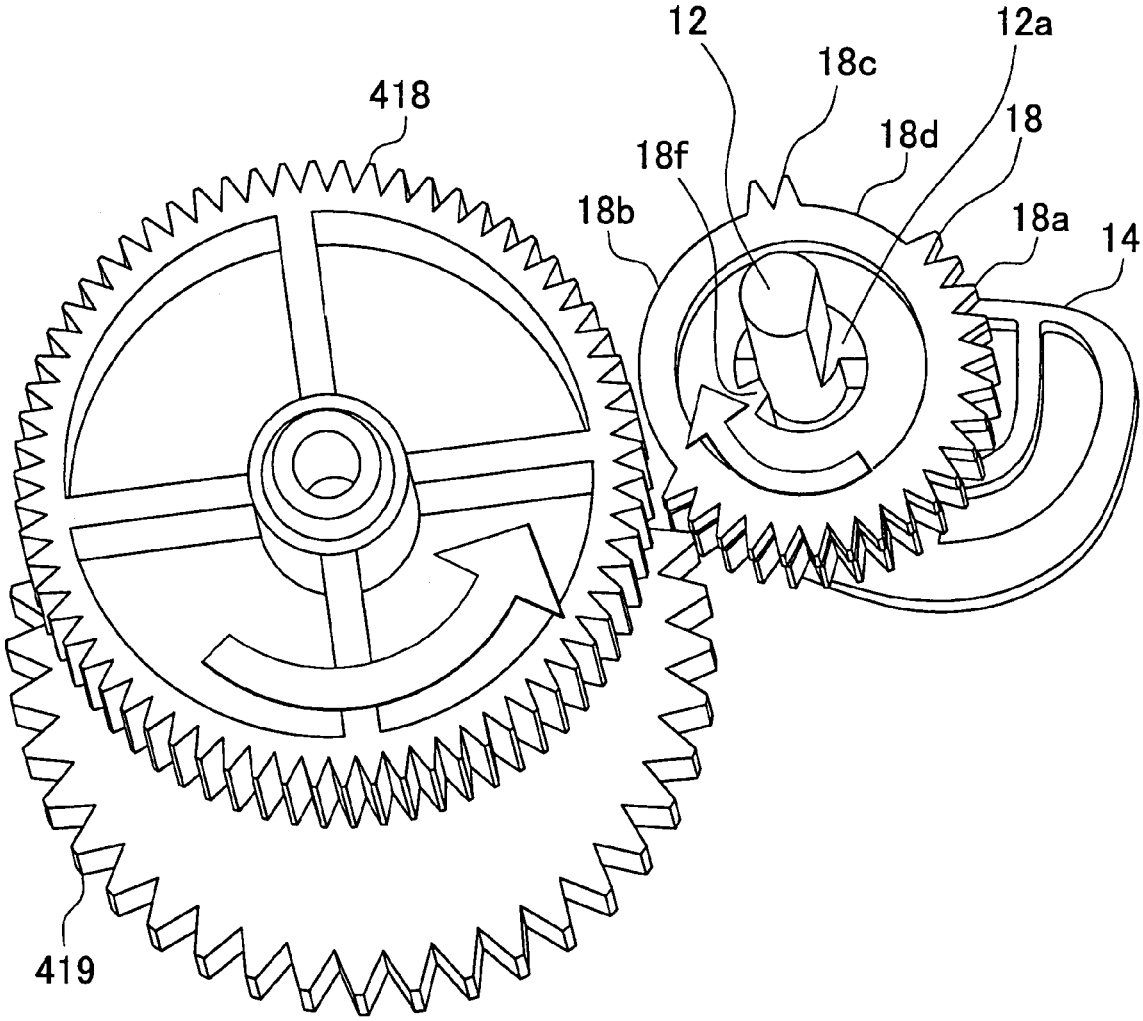
FIG. 11 shows a state where a cap starts to be moved upwards.

FIG. 11 shows an example of the position relation between the cap moving mechanism 170 and the cap driving gear 418 when the cap 72 starts to be moved downwards. Here, when the cap driving gear 418 is rotated anti-clockwise in order to move the cap 72 upwards, the spur gear 20 is rotated always engaged with the cap driving gear 418 and energized to the toothed gear 18 by the energizing part 22, and thus the toothed gear 18 is rotated as the spur gear 20 is rotated. Due to this, the drive region 18*c* of the toothed gear 18 is engaged with the cap driving gear 418, and the driving force of the cap driving gear 418 is transmitted to the toothed gear 18. Meanwhile, since there is a play space 12*c* between the projection part 18*f* of the toothed gear 18 and the engaging part 12*a* of the cam shaft 12, the toothed gear 18 does not rotate the cam shaft 12 in this state. Therefore, with the rotation of the motor 410, a time lag can be generated with regard to the advance of the wiper 80 and the rise of the cap 72. From when the driving force stops being transmitted to the conveying part 500 as shown in FIG. 6 to when the wiper 80 moves forward is the time lag A shown in FIG. 4.

When the toothed gear 18 is further rotated, the play space 12*c* between the projection part 18*f* of the toothed gear 18 and the engaging part 12*a* of the cam shaft 12 is blocked, the projection part 18*f* of the toothed gear 18 and the engaging part 12*a* of the cam shaft 12 are engaged with each other. When the projection part 18*f* of the toothed gear 18 and the engaging part 12*a* of the cam shaft 12 are engaged with each other, the driving force of the cap driving gear 418 is transmitted to the cam shaft 12 via the toothed gear 18, and then the cam shaft 12 starts to be rotated clockwise as shown by the directing arrow in FIG. 11.

As the cam shaft 12 is rotated clockwise, the drive region 312 of the wiper driving gear part 310 arranged at the cam shaft 12 is engaged with the drive region 312 of the wiper driven gear part 320, then the wiper driven gear part 320 is rotated, and then the wiper 80 is raised upwards. In addition, as the cam shaft 12 is rotated clockwise, the pushing-up part 14 is also rotated clockwise, whereas the cap 72 is not moved upwards while engaged with the circumferential part 14*a* of the pushing-up part 14 in the state where the pushing-up part 14 starts to be rotated. Therefore, a time lag can be further generated with regard to the rise of the cap 72. From when the wiper 80 moves forward to when the cap 72 starts to be moved upwards is the time lag B shown in FIG. 4.

Figure 12:
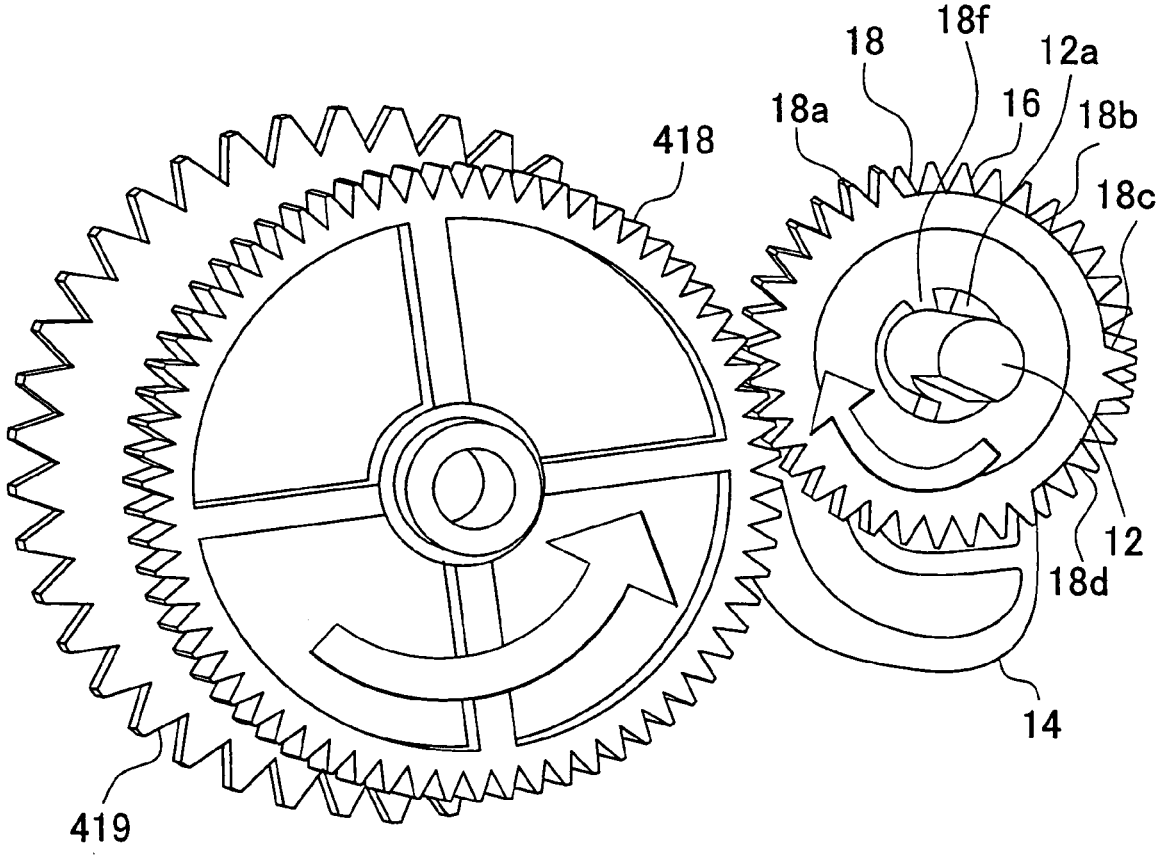
FIG. 12 shows a state where a cap is being moved upwards.

FIG. 12 shows an example of the position relation between the cap moving mechanism 170 and the cap driving gear 418 when the cap 72 is being moved upwards. The cam shaft gear 16 is rotated by the rotation of the cap shaft 12, the drive region 16*a* of the cam shaft gear 16 and the drive region 18*a* of the toothed gear 18 are engaged with the cap driving gear 418, and then the pushing-up part 14 formed integrally with the cam shaft 12 is rotated clockwise together with the cam shaft 12 as shown by the directing arrow in FIG. 12.

As the cam shaft 12 is further rotated clockwise from the state shown in FIG. 12, the pushing-up part 14 is also further rotated clockwise, the cap 72 is engaged with the projection part 14*b* of the pushing-up part 14, and then the cap 72 is pushed up and moved upwards by the projection part 14*b*.

Figure 13:
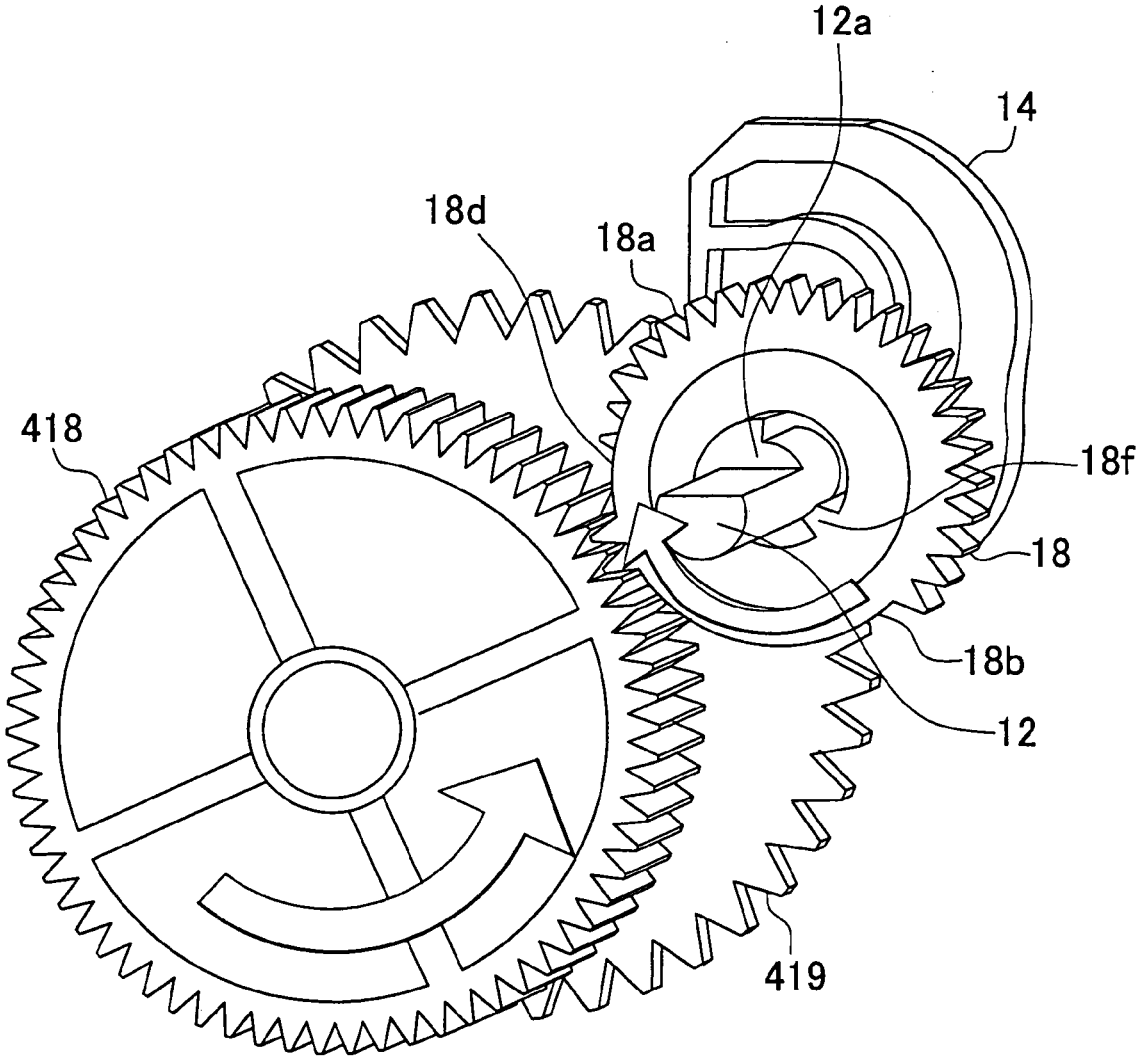
FIG. 13 shows a state where a cap has been completely moved upwards.

FIG. 13 shows an example of the position relation between the cap moving mechanism 170 and the cap driving gear 418 in the state where the cap 72 has been completely moved upwards. When the pushing-up part 14 has been completely moved upwards, the non-drive region 18*b* of the toothed gear 18 and the non-drive region 16*b* of the cam shaft gear 16 are arranged at a position facing the cap driving gear 418, and thus the toothed gear 18 and the cam shaft gear 16 are disengaged with the cap driving gear 418. Further, the toothed gear 18 is rotated by the friction between the spur gear 20 and the toothed gear 18, and the tips of the drive region 18*c* of the toothed gear 18 are away from the cap driving gear 418.

Therefore, if the driving force of the motor 410 is used for a purpose other than moving the cap 72, the toothed gear 18 and the cam shaft gear 16 are not engaged with the cap driving gear 418. Accordingly, the driving force of the motor 410 is transmitted to the camshaft 12, so that the tooth skipping sound does not occur. At this time, the spur gear 20 is being engaged with the cap driving gear 418 whereas the spur gear 20 is rotated freely to the cam shaft 12, and thus the tooth skipping sound caused by the rotation of the spur gear 20 does not occur.

Figure 14:
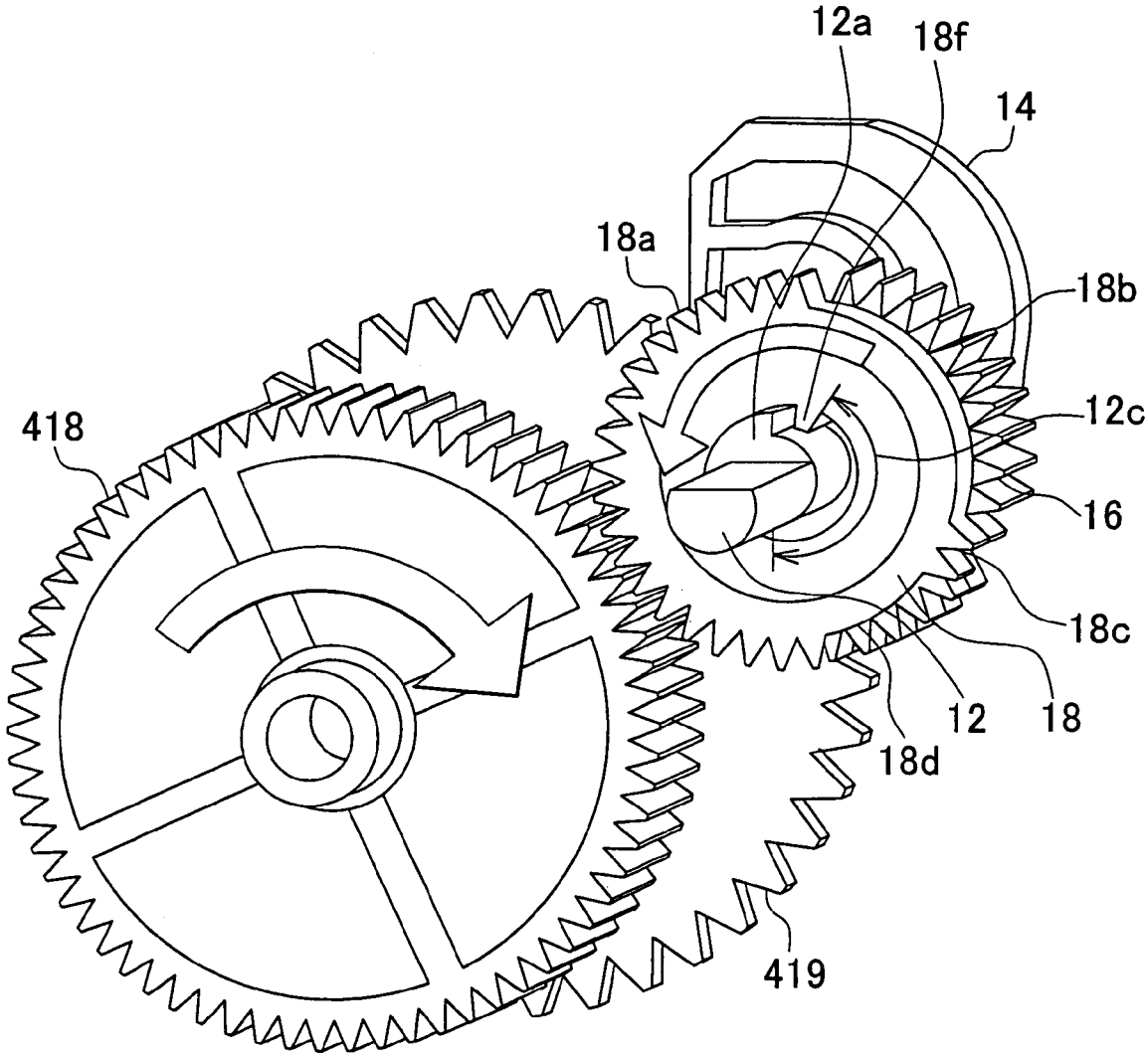
FIG. 14 shows a state where a cap starts to be moved downwards.

FIG. 14 shows an example of the position relation between the cap moving mechanism 170 and the cap driving gear 418 when the cap 72 starts to be moved downwards. In case of moving the cap 72 downwards, the cap driving gear 418 is rotated clockwise in contrast to move the cap 72 upwards. Since the spur gear 20 is rotated anti-clockwise by the cap driving gear 418, the toothed gear 18 in contact with the spur gear 20 is rotated anti-clockwise accompanying the spur gear 20. Due to this, the drive region 18*a* of the toothed gear 18 is engaged with the cap driving gear 418.

Figure 15:
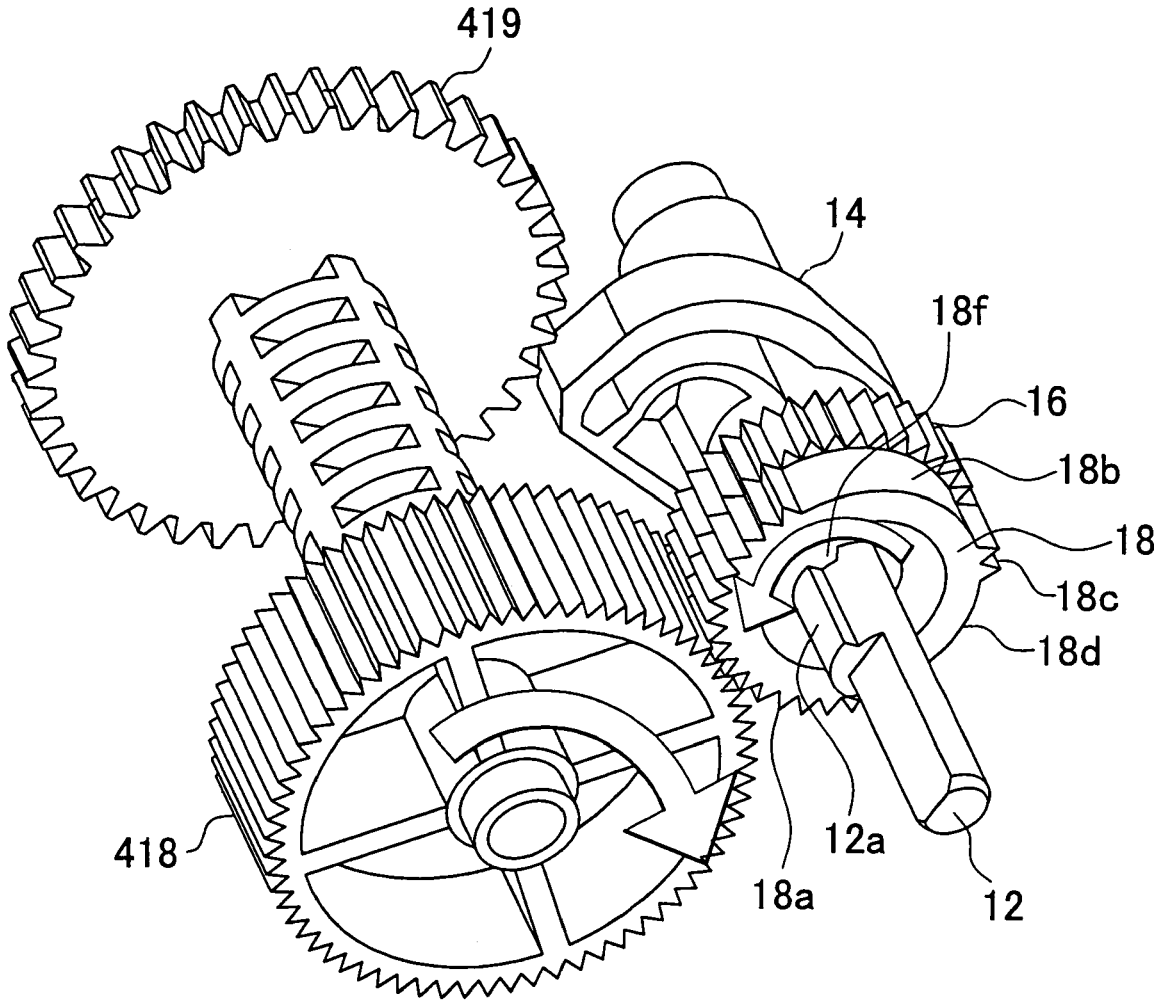
FIG. 15 shows a state where a cap is being moved downwards.

FIG. 15 shows an example of the position relation between the cap moving mechanism 170 and the cap driving gear 418 when the cap 72 is being moved downwards. When the toothed gear 18 is rotated anti-clockwise accompanying the spur gear 202, the drive region 18*c* of the toothed gear 18 is engaged with the cap driving gear 418, and the driving force of the cap driving gear 418 is transmitted to the toothed gear 18. Meanwhile, since there is the play space 12*c* between the projection part 18*f* of the toothed gear 18 and the engaging part 12*a* of the cam shaft 12, the toothed gear 18 does not rotates the cam shaft 12 in this state. Therefore, with the rotation of the motor 410, it is possible to generate a time lag with regard to the retraction of the wiper 80 and the fall of the cap 72.

Further, when the toothed gear 18 is rotated, the play space 12*c* between the projection part 18*f* of the toothed gear 18 and the engaging part 12*a* of the cam shaft 12 is blocked, the projection part 18*f* of the toothed gear 18 and the engaging part 12*a* of the cam shaft 12 are engaged with each other. Accordingly, the cam shaft 12 is rotated by the rotation of the toothed gear 18, and the drive region 18*a* of the toothed gear 18 and the drive region 16*a* of the cam shaft gear 16 are engaged with the cap driving gear 418. Due to this, the pushing-up part 14 is rotated anti-clockwise together with the cam shaft 12, and the cap 72 is moved downwards. From when the spur gear 20 starts to be rotated anti-clockwise to when the cap 72 starts to be moved downwards is the time lag D shown in FIG. 5.

When the cap 72 is moved downwards, although the load of the cap 72 is applied to the pushing-up part 14 so that the pushing-up part 14 might be kicked, the driving force of the motor 410 is transmitted to the cam shaft 12 via the cam shaft gear 16 and the toothed gear 18, and thus the cam shaft 12 is rotated smoothly.

While the non-drive region 324 of the wiper driven gear part 320 faces the non-drive region 314 of the wiper driving gear part 310 in the state where the cam shaft 12 starts to be rotated anti-clockwise, the wiper 80 is not retracted from the movement path of the recording head 44 without the driving force of the motor 410 transmitted to the wiper driven gear part 320. Therefore, a time lag can be further generated with regard to the retraction of the wiper 80. From when the cap 72 is moved downwards to when the wiper 80 is retracted is the time lag E shown in FIG. 5. When the cam shaft 12 is further rotated anti-clockwise from this state, the wiper driving gear part 310 is also rotated, and the drive region 312 of the wiper driving gear part 310 is engaged with the drive region 322 of the wiper driven gear part 320. Due to this, the wiper driving gear part 310 is rotated clockwise, and the wiper 80 is retracted from the movement path of the recording head 44.

Further, when the cap driving gear 418 is rotated clockwise, the non-drive region 18*b* of the toothed gear 18 and the non-drive region 16*b* of the cam shaft gear 16 are arranged at a position facing the cap driving gear 418, so that the toothed gear 18 and the cam shaft gear 16 are disengaged with the cap driving gear 418 as shown in FIG. 10, and the driving force of the motor 410 is transmitted to the cam shaft 12.

As described above, the cap moving mechanism 170 can generate a predetermined time lag. Further, the cap moving mechanism 170 can prevent the tooth skipping sound from occurring. Further, the cap moving mechanism 170 can move the cap 72 up and down smoothly.

Figure 16:
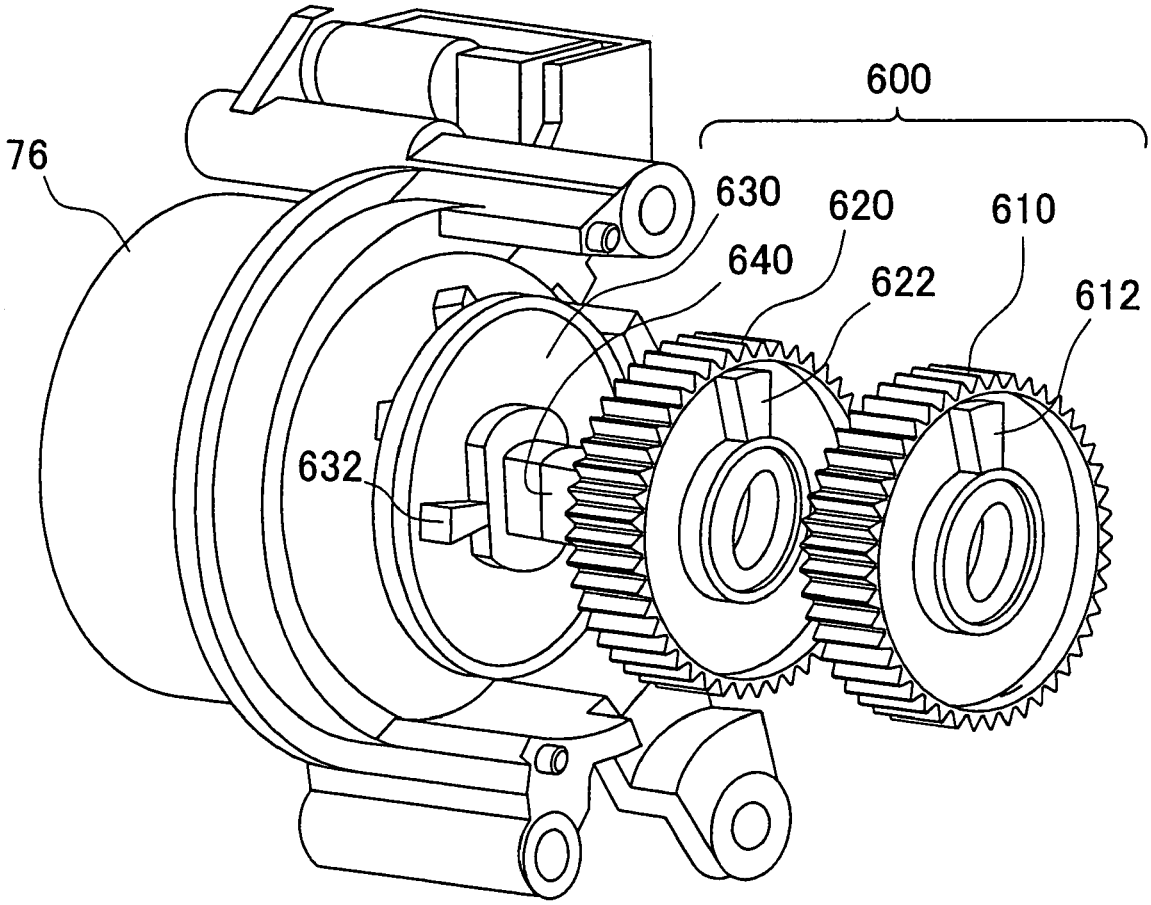
FIG. 16 is an exploded and perspective view of a pump driving mechanism.

FIG. 16 is an exploded and perspective view of a pump driving mechanism 600 for driving the pump 76. The pump driving mechanism 600 includes a pump-side gear 630 for driving the pump to operate suction by engaging with the pump 76 and rotating in one direction, a rotating shaft 640 extending from the center of the pump-side gear 630 and rotating integrally with the pump-side gear 630, an intermediate gear 620 fitted with the rotating shaft 640 and an outside gear 610 fitted with the rotating shaft 640 outside the intermediate gear 620. Further, in a case where the pump-side gear 630 rotates in the reverse direction, a pulley (not shown), which contacts with the tube 75, moves inwardly and disengages from the tube 75 so that the tube 75 is not deformed by the pulley. Accordingly, neither the suction operation nor discharge operation occurs when the pump-side gear 630 rotates in the reverse direction.

The outside gear 610 is always engaged with the second gear 414, and can be rotated freely to the rotating shaft 640. In addition, the intermediate gear 620 can also be rotated freely to the rotating shaft 640. Moreover, the outside gear 610 includes a claw 612 on a surface facing the intermediate gear 620. In FIG. 16, however, the claw 612 is shown as if it can also be seen outside for the sake of description. In the same way, the intermediate gear 620 includes claws 622 on a surface facing the outside gear 610 and on a surface facing the pump-side gear 630, and the pump-side gear 630 includes a claw 632 on a surface facing the intermediate gear 620.

Therefore, when the outside gear 610 is driven to rotate by the second gear 414, the outside gear 610 is rotated freely to the intermediate gear 620 until the claw 612 is engaged with the claw 622 of the intermediate gear 620 with regard to the rotating direction, and after the claw 612 is engaged with the claw 622, the intermediate gear 620 is rotated accompanying the outside gear 610. Further, when the intermediate gear 620 is rotated accompanying the outside gear 610, the intermediate gear 620 is rotated freely to the pump-side gear 630 until the claw 622 is engaged with the claw 632 of the pump-side gear 630 in the rotating direction, and after the claw 622 is engaged with the claw 632, the pump-side gear 630 is rotated accompanying the intermediate gear 620.

Accordingly, until the claw 612 of the outside gear 610 and the claw 622 of the intermediate gear 620 and the claw 622 of the intermediate gear 620 and the claw 632 of the pump-side gear 630 are engaged with each other respectively, the driving force of the motor 410 is not transmitted to the pump-side gear 630. Therefore, although the motor 410 is rotating during this time, it is possible to generate a time lag not to drive the pump 76. Particularly, the claws 612, 622 and 632 are set in order that the start point of driving the rotating shaft 640 to rotate shown in FIG. 16 are later than the rise or fall of the cap 72 and the advance or retraction of the wiper 80 shown in FIGS. 11 to 15. Therefore, from the rise of the cap 72 to the drive of the pump 76 is the time lag C shown in FIG. 4, and from the retraction of the wiper 80 to the reverse rotation of the pump-side gear 630 is the time lag F.

As above, according to the present embodiment, using one motor 410 for supplying the driving force to the conveying part 500, it is possible to drive the wiper 80, the cap 72 and the pump 76 sequentially. Therefore, the number of parts can be reduced as compared with a driving means for driving the wiper 80, the cap 72 and the pump 76 separately from the motor 410 for supplying the driving force to the conveying part 500.

In addition, since a time lag is provided between the drive of the wiper 80 and the drive of the cap 72, the wiper 80 can wipe the recording head 44 with more reliability while the cap 72 does not seals the recording head 44. Further, since a time lag is provided between the drive of the cap 72 and the drive of the pump 76, the cap can seal the liquid ejecting head with more reliability while the pump is not driven.

The inkjet type recording apparatus 10 was described as an embodiment above. However, the present invention is not limited to the inkjet type recording apparatus 10. As another example of the liquid ejecting apparatus, there is a color filter manufacturing apparatus for manufacturing a color filter of a liquid crystal display. In this case, a color material ejecting head of the color filter manufacturing apparatus is an example of the liquid ejecting head. Further another example of the liquid ejecting apparatus is an electrode forming apparatus for forming electrodes such as an organic EL display, a FED (Field Emission Display) or the like. In this case, an electrode material (conduction paste) ejecting head of the electrode forming apparatus is an example of the liquid ejecting head. Further another example is a biochip manufacturing apparatus for manufacturing biochips. In this case, a bio organism ejecting head of the biochip manufacturing apparatus and a sample ejecting head as a minute pipette are examples of the liquid ejecting head. The liquid ejecting apparatus of the present invention includes other liquid ejecting apparatuses used for industrial purposes.

Although the present invention has been described by way of exemplary embodiments, it should be understood that those skilled in the art might make many changes and substitutions without departing from the spirit and the scope of the present invention which is defined only by the appended claims.

What is claimed is:

1. A cap moving mechanism for moving a cap for sealing a liquid ejecting head for ejecting liquid to a target, comprising:

a pushing-up part for moving said cap upwards or downwards by rotating;

a cam shaft provided integrally with said pushing-up part as a rotating shaft of said pushing-up part;

a cam shaft gear comprising a drive region, which rotates integrally with said cam shaft taken as a rotating shaft, whereby a driving force of a motor for driving said cam shaft is transmitted, and a non-drive region whereby said driving force of said motor is not transmitted; and a driving force transmission gear for transmitting said driving force of said motor to said cam shaft gear in order that said cap can be moved downwards from a state in which said cap has been completely moved upwards, after said motor rotates by a predetermined amount from when said cap has been completely moved upwards, and transmitting said driving force of said motor to said cam shaft gear in order that said cap can be moved upwards from a state in which said cap has been completely moved downwards, after said motor rotates by a predetermined amount from when said cap has been completely moved downwards;

wherein said driving force transmission gear comprises:

a toothed gear comprising a drive region whereby said driving force of said motor is transmitted and a non-drive region whereby said driving force of said motor is not transmitted;

a spur gear being in contact with said toothed gear;

an energizing part for transmitting a rotating force of said spur gear to said toothed gear, and said spur gear rotates freely against said cam shaft taken as a center axis, said spur gear receiving said driving force of said motor, said spur gear energized by said energizing part towards said toothed gear, said toothed gear thereby being rotated accompanying said spur gear, wherein said toothed gear is arranged between said cam shaft gear and said spur gear.

2. A cap moving mechanism as claimed in claim 1, wherein said toothed gear further comprises two of said non-drive regions between which said drive region is held.

3. A cap moving mechanism as claimed in claim 1 further comprising:

at least two of said pushing-up parts between which said cam shaft gear, said toothed gear, said spur gear and said energizing part are arranged.

4. A cap moving mechanism as claimed in claim 1, wherein said pushing-up part is cam-shaped.

5. A cap moving mechanism as claimed in claim 1, wherein said toothed gear can rotate freely against said cam shaft taken as a center axis by a predetermined rotation angle.

6. A cap moving mechanism as claimed in claim 5, wherein said drive region of said toothed gear is arranged in at least a part of an angle area in which said non-drive region of said cam shaft gear is arranged with regard to said cam shaft.

7. A liquid ejecting apparatus for ejecting liquid to a target, comprising:

a liquid ejecting head for ejecting liquid to said target;

a cap for sealing said liquid ejecting head;

a pushing-up part for moving said cap upwards or downwards by rotating;

a cam shaft provided integrally with said pushing-up part as a rotating shaft of said pushing-up part;

a cam shaft gear comprising a drive region, which rotates integrally with said cam shaft taken as a rotating shaft, whereby a driving force of a motor for driving said cam shaft is transmitted, and a non-drive region whereby said driving force of said motor is not transmitted; and a driving force transmission gear for transmitting said driving force of said motor to said cam shaft gear in order that said cap can be moved downwards from a state in which said cap has been completely moved upwards, after said motor rotates by a predetermined amount from when said cap has been completely moved upwards, and transmitting said driving force of said motor to said cam shaft gear in order that said cap can be moved upwards from a state in which said cap has been completely moved downwards, after said motor rotates by a predetermined amount from when said cap has been completely moved downwards;

wherein said driving force transmission gear comprises:

a toothed gear comprising a drive region whereby said driving force of said motor is transmitted and a non-drive region whereby said driving force of said motor is not transmitted;

a spur gear being in contact with said toothed gear;

an energizing part for transmitting a rotating force of said spur gear to said toothed gear, and said spur gear rotates freely against said cam shaft taken as a center axis, said spur gear receiving said driving force of said motor, said spur gear energized by said energizing part towards said toothed gear, said toothed gear thereby being rotated accompanying said spur gear, wherein said toothed gear is arranged between said cam shaft gear and said spur gear.

8. A cap moving mechanism for moving a cap for sealing a liquid ejecting head for ejecting liquid to a target, comprising:

a pushing-up part for moving said cap upwards or downwards by rotating;

a cam shaft provided integrally with said pushing-up part as a rotating shaft of said pushing-up part;

a cam shaft gear comprising a drive region, which rotates integrally with said cam shaft taken as a rotating shaft, whereby a driving force of a motor for driving said cam shaft is transmitted, and a non-drive region whereby said driving force of said motor is not transmitted; and a driving force transmission gear for transmitting said driving force of said motor to said cam shaft gear in order that said cap can be moved downwards from a state in which said cap has been completely moved upwards, after said motor rotates by a predetermined amount from when said cap has been completely moved upwards, and transmitting said driving force of said motor to said cam shaft gear in order that said cap can be moved upwards from a state in which said cap has been completely moved downwards, after said motor rotates by a predetermined amount from when said cap has been completely moved downwards;

wherein said driving force transmission gear comprises:

a toothed gear comprising a drive region whereby said driving force of said motor is transmitted and a non-drive region whereby said driving force of said motor is not transmitted;

a spur gear being in contact with said toothed gear;

an energizing part for transmitting a rotating force of said spur gear to said toothed gear;

said spur gear rotates freely against said cam shaft taken as a center axis, said spur gear receiving said driving force of said motor, said spur gear energized by said energizing part towards said toothed gear, said toothed gear thereby being rotated accompanying said spur gear; and at least two of said pushing-up parts between which said cam shaft gear, said toothed gear, said spur gear and said energizing part are arranged.

9. A cap moving mechanism as claimed in claim 8, wherein said toothed gear further comprises two of said non-drive regions between which said drive region is held.

10. A cap moving mechanism as claimed in claim 8, wherein said pushing-part is cam-shaped.

11. A cap moving mechanism as claimed in claim 8, wherein said toothed gear can rotate freely against said cam shaft taken as a center axis by a predetermined rotation angle.

12. A cap moving mechanism as claimed in claim 11, wherein said drive region of said toothed gear is arranged in at least a part of an angle area in which said non-drive region of said cam shaft gear is arranged with regard to said cam shaft.

* * * * *